US006953238B2

(12) United States Patent
Koitabashi et al.

(10) Patent No.: US 6,953,238 B2
(45) Date of Patent: Oct. 11, 2005

(54) RECORDING APPARATUS AND RECORDING METHOD AND PROGRAM

(75) Inventors: Noribumi Koitabashi, Kanagawa (JP); Masataka Yashima, Tokyo (JP); Tsuyoshi Shibata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 295 days.

(21) Appl. No.: 10/285,529

(22) Filed: Nov. 1, 2002

(65) Prior Publication Data

US 2003/0085949 A1 May 8, 2003

(30) Foreign Application Priority Data

Nov. 6, 2001 (JP) ..... 2001-340912
Oct. 23, 2002 (JP) ..... 2002-308373

(51) Int. Cl.[7] ..... B41J 2/21; B41J 29/393
(52) U.S. Cl. ..... 347/43; 347/19
(58) Field of Search ..... 347/43, 19, 9, 347/15, 105

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 4,963,882 A | * | 10/1990 | Hickman | 347/43 |
| 5,124,720 A | | 6/1992 | Schantz | |
| 5,528,270 A | | 6/1996 | Tajika et al. | 347/19 |
| 5,880,751 A | | 3/1999 | Nishikori et al. | 347/14 |
| 5,894,314 A | | 4/1999 | Tajika et al. | 347/14 |
| 6,010,205 A | | 1/2000 | Billet | |
| 6,033,054 A | | 3/2000 | Takagi | 347/43 |
| 6,174,039 B1 | | 1/2001 | Miyake et al. | 347/12 |
| 6,273,542 B1 | * | 8/2001 | Couwenhoven et al. | 347/19 |
| 2001/0026293 A1 | | 10/2001 | Kaneko | |

FOREIGN PATENT DOCUMENTS

| | | |
|---|---|---|
| EP | 0 836 153 | 4/1998 |
| EP | 0 983 855 | 3/2000 |
| JP | 59-123670 | 7/1984 |
| JP | 59-138461 | 8/1984 |
| JP | 5-301427 | 11/1993 |
| JP | 6-79956 | 3/1994 |
| JP | 2001-315363 | 11/2001 |

* cited by examiner

*Primary Examiner*—Thinh Nguyen
(74) *Attorney, Agent, or Firm*—Fitzpatrick, Cella, Harper & Scinto

(57) ABSTRACT

A recording system can take the form of a recording apparatus, a recording method or a program to control the recording apparatus for recording a color image on a recording medium by utilizing a recording head on which a plurality of recording elements are arranged. The recording system uses a plurality of compensation methods to compensate a position to be recorded by a recording element which does not execute a recording operation among the plurality of recording elements and selects an appropriate compensation method. Such recording system can resolve nonuniformity in the recorded image such as white streaks and the like generated by non-eject dots and can make the nonuniformity be unrecognized by the human eye. In addition, the recording system can suppress increase in costs of the recording head and can significantly increase recording rates.

22 Claims, 27 Drawing Sheets

$$AVE = \frac{1}{128} \sum^{i} n(i)$$

$$ave(i) = \{ n(i-1) + n(i) + n(i+1) \} / 3$$

RECORDING APPARATUS AND RECORDING METHOD AND PROGRAM

BACKGROUND OF THE INVENTION

1. Field of the Invention

The present invention relates to a recording apparatus and a recording method using a recording head, on which a plurality of recording elements are arranged. In particular the present invention relates to a recording apparatus such as an ink jet printer and the like using the recording head by ejecting ink from a plurality of nozzles arranged thereon.

2. Brief Description of the Related Art

Recently, recording apparatuses employing an ink-jet method for recording on a recording medium by ejecting ink from nozzles arranged on the recording head have been widely applied to printers, facsimile machines, copying machines and so forth. Particularly, color printers capable of recording color images by using a plurality of colors have been remarkably widely used as images of high quality have been enhanced with progress of the color printers. In addition to a high quality image, a higher recording rate is an important factor for the recording apparatus to increase in popularity, so liquid droplet eject driving frequencies of recording heads have been raised higher along with an increase in the number of nozzles arranged in the recording heads for higher-rated recording.

However, in inkjet apparatuses, sometimes so-called "non-eject" states, where ink droplets cannot be ejected, are caused by dust entered into nozzles of the recording head during production of the head, deteriorated nozzles due to a long period of use, deteriorated ejection elements, and so forth. In the case of the non-eject state caused by deteriorated nozzles or elements, it is likely that the non-eject state happens casually when the recording apparatuses are in use.

In some cases, states where ejecting directions of ink droplets are deviated greatly from a desired direction (hereinafter also referred to as "twisted ejection") and states where ejecting volumes of ink droplets are much different from a desired volume (hereinafter also referred to as "dispersion in droplet diameter") are observed instead of non-eject states. Since such deteriorated nozzles largely deteriorate quality of recorded images, these nozzles cannot be employed for recording. Hereinafter such nozzles are also included in and explained as the non-eject statuses or states.

Such non-eject statuses and so forth were not so problematic in the past, since non-eject status generating frequencies could be suppressed by modifying manufacturing conditions and the like. However, the non-eject statuses have become problems not to be ignored, as nozzle numbers have been increased for attaining the above-mentioned higher-rate recording. In order to manufacture recording heads which do not include non-eject nozzles and excellent recording heads which hardly cause the non-eject statuses, manufacturing costs will be increased, which leads to higher cost recording beads.

When the non-eject statuses occur, defects such as white streaks and the like are observed in recorded images. In order to compensate such white streaks, some techniques are performed such that white streaks are compensated by recording with other normal nozzles by utilizing a divided recording method where the recording head is scanned a plurality of times for recording.

However, in order to attain the above-mentioned higher-rate recording, it is preferable to finish recording by one scanning, so called "one path recording", but it is very difficult to compensate unrecorded portions due to the non-eject statuses or to make such portions unrecognizable in the one path recording. In another recording method for recording by executing a plurality of scannings on a predetermined area of a recording medium, so-called "multi scan", sometimes it is difficult to compensate completely depending on positions or the number of non-eject nozzles.

SUMMARY OF THE INVENTION

The present invention is carried out in view of the above-mentioned problems, and to provide an ink-jet recording apparatus capable of removing unevenness such as white streaks and the like generated in recorded images due to unrecorded dots caused by the non-eject statuses, or making white streaks unrecognizable by human eyes even when the non-eject statuses occur in order to suppress cost increase of the recording head. Further the present invention provides a recording apparatus capable of recording at a higher recording rate.

The following constitution of the present invention solves the problems mentioned above.

(1) A recording apparatus, for recording a color image on a recording medium by utilizing a recording head on which a plurality of recording elements are arrayed, includes recording head driving means to drive the plurality of recording elements of the recording head in accordance with image data; a plurality of compensation means to compensate a position to be recorded by a recording element which does not execute a recording operation, among the recording elements, by utilizing respectively different methods; and selection means to employ selectively at least one compensation means from the plurality of compensation means in accordance with a kind of medium to be recorded.

(2) In the recording apparatus described above, the plurality of compensation means comprises a first compensation means which executes a compensation recording operation on a corresponding position where the recording element does not execute the recording operation, by a different color from the color corresponding to the recording element which does not execute the recording operation.

(3) In the recording apparatus described above, the plurality of compensation means comprises a second compensation means which compensates a position to be recorded by the recording element which does not execute the recording operation by correcting image data corresponding to recording elements in the vicinity of the recording element which does not execute the recording operation based on image data corresponding to the recording element which does not execute the recording operations (4) In the recording apparatus described above, said plurality of compensation means comprises a first compensation means which executes compensation recording on a position to be recorded by the recording element which does not execute the recording operation, by a different color from the color corresponding to the recording element which does not execute the recording operation; and a second compensation means which executes compensation recording on a position to be recorded by the recording element which does not execute the recording operation by correcting image data corresponding to recording elements in the vicinity of the recording element which does not execute the recording operation based on image data corresponding to the recording element which does not execute the recording operation.

(5) In the recording apparatus described above, when the kind of medium is a first medium to be recorded, only the second compensation means is selected, and when the kind of medium is a second medium to be recorded, at least the first compensation means is selected.

(6) In the recording apparatus described above, the selection means selects only the second compensation means when the kind of medium is the first medium to be recorded, and the selection means selects both the first compensation means and the second compensation means when the kind of medium is the second medium to be recorded.

(7) In the recording apparatus described above, the first medium to be recorded is ordinary paper, and the second medium to be recorded is glossy paper.

(8) In the recording apparatus described above, the first recording medium to be recorded is a medium with a blotting rate of 2.5 or more, and the second recording medium to be recorded is a medium with a blotting rate less than 2.5.

(9) In the recording apparatus described above, the first compensation means executes recording operations corresponding respectively to a plurality of colors, and at the same time executes compensation recording operations by employing a color having similar lightness to a color corresponding to the recording element which does not execute the recording operation.

(10) In the recording apparatus described above, the first compensation means has a correction means for correcting image data corresponding to the recording element which does not execute the recording operation in accordance with a color corresponding to a recording element employed for a compensation recording operation, and executes the compensation recording based on the corrected image data by the compensation means.

(11) In the recording apparatus described above, the second compensation means corrects density data indicated by image data corresponding to recording elements in the vicinity of the recording element which does not execute the recording operation, based on density data indicated by image data corresponding to the recording element which does not execute the recording operation.

(12) In the recording apparatus described above, the recording element which does not execute the recording operation includes a recording element incapable of executing the recording operation.

(13) In the recording apparatus described above, the recording head is an ink-jet head having a plurality of nozzles from which ink is ejected for recording when the recording elements are driven.

(14) In the recording apparatus described above, each recording element consists of an electro-thermal body which supplies thermal energy to ink so that ink is ejected from a corresponding nozzle by bubbles generated in the ink by the thermal energy.

(15) In the recording apparatus described above, the recording head further comprises measuring means to measure a blotting rate of the medium to be recorded.

(16) In the recording apparatus described above, the recording head further comprises control means to control an ejecting quantity of the recording head in order to execute the compensation recording operation only by the second compensation means, when the first medium to be recorded is selected.

(17) A recording method, for recording a color image on a recording medium by utilizing a recording head on which a plurality of recording elements are arrayed, includes steps of identifying a recording element which does not execute a recording operation; recognizing a kind of medium to be recorded; selecting at least one compensation method among a plurality of respectively different compensation methods for compensating a position to be recorded by a recording element which does not execute the recording operation; and recording for compensation on the position to be recorded by the recording element which does not execute the recording operation. In the selecting step, at least one compensation method is selected among the plurality of respectively different compensation methods in accordance with the kind of medium to be recorded recognized in said recognizing step.

(18) Also included is a program for carrying out the method described above.

(19) A program, to run a computer for controlling a recording apparatus for recording a color image on a recording medium by utilizing a recording head on which a plurality of recording elements are arrayed, includes steps of identifying a recording element which does not execute a recording operation; recognizing kinds of media to be recorded; selecting at least one compensation method among a plurality of respectively different compensation methods for compensating a position to be recorded by a recording element which does not execute the recording operation in accordance with a kind of recognized medium.

DETAILED DESCRIPTION OF PREFERRED EMBODIMENTS

Figure 1A:
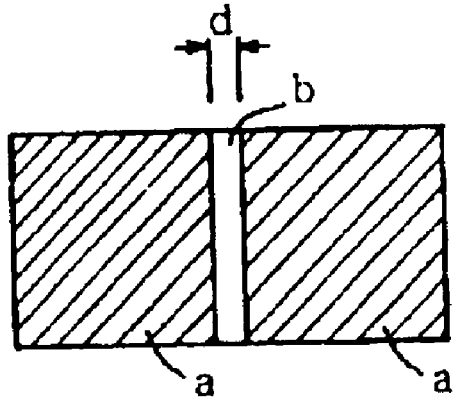
FIG. 1A is a schematic drawing showing a defect status of a recorded image.

Hereinafter preferred embodiments of the present invention are explained.

In this specification nozzles where non-eject statuses occur, nozzles of which eject directions of ink droplets are largely deviated from a desired direction and nozzles which eject ink volumes largely different from a desired ink volume are considered nozzles in incapable states of recording. In the present invention these nozzles are treated as nozzles which do not execute recording operations or as recording elements which do not execute recording operations. Recording operations to compensate positions not recorded by these nozzles or positions not recorded by these nozzles are explained in detail. Nozzles or recording elements brought to abnormal recording statuses are also represented as bad nozzles or bad recording elements in this specification.

Through diligent research and study on compensation methods against non-eject statuses, the present inventors learned that it is preferable to use a plurality of compensation methods properly in accordance with media to be recorded.

Namely, since blotting behaviors of deposited ink droplets on media to be recorded are different depending on the media, compensation methods to remove streaks caused by non-eject statuses are different.

Here a blotting rate is defined for description hereinafter. An ink droplet ejected from the recording head is impacted and diffused on a medium to be recorded so that a dot is formed on the medium. The blotting rate is defined as a ratio of dot diameter to ink droplet diameter.

A criterion value to judge whether the blotting rate is large or small is considered about 2.5 times.

In other words, it is a known observed fact that an ink droplet ejected from the inkjet recording apparatus and impacted on the medium can result in a diameter of the impacted droplet to be about two times a diameter of a flying ink droplet.

Afterward, the impacted ink droplet is absorbed in the medium to be recorded. In the medium to be recorded with high permeability of ink, even in a case of so called ordinary paper such as PPC (Plain Paper Copier) in which a sizing agent as an anti-blotting agent is included, the ink droplet permeates to a large extent so that the blotting rate goes beyond 2.5 times. When permeability of ink is low, ink does not permeate too much after the impact on the medium. Since ink dots are formed depending evaporating and swelling statuses of volatile components in ink, the blotting rate does not greatly exceed two times, and is sometimes less than two times.

Regardless of ink permeability, special media, on which coat layers are formed for controlling blotting behaviors of ink, are mainly used so as to make dot diameter smaller for enhancing image quality by improving granular feel of the dot. The blotting rate of glossy paper is around two times.

In other words, coat layers are formed so as to suppress permeability in a horizontal direction on the media surfaces.

In a medium to be recorded with high blotting rate, it is possible to make nonuniformity hardly noticeable by recording more dots from neighboring nozzles including nozzles adjacent to a non-eject nozzle, when a width of a non-eject portion is narrow. In a recording operation with a high recording duty, when a solid area image is recorded with increased quantity of ink per unit area of the medium, non-eject portions on the image cannot be recognized due to spreading blots of a dot group toward a non-eject area on the medium.

On the other hand, in a recording operation with a low recording duty, it is possible to make nonuniformity hardly recognizable by recording more dots from neighboring nozzles including nozzles adjacent to the non-eject nozzle as shown in FIGS. 3A to 3E so as to compensate macroscopic density regardless of media to be recorded.

Though a width of a non-eject portion that is hardly recognized varies depending on the volume of the ink droplets, the width is preferably within around 70 μm for the non-eject portion to be compensated by dots from neighboring nozzles including nozzles neighboring the non-eject portion.

Ink with high permeability is preferable when ordinary paper is recorded. The preferable blotting rate is more than 2.5 times. It is desirable to employ a coated paper and the like with the blotting rate more than 2.5 times, even if ink with low permeability is employed.

In the glossy paper with the blotting rate less than 2.5, original dot diameters are small and dot groups are hardly spread even when recorded more from neighboring dots; consequently, the non-eject portion is hardly compensated. Therefore, compensation by other color dots is effective.

Whether compensations by other colors are executed on media to be recorded or not can be predetermined by the main body of the recording apparatus, a printer driver or the like. It is preferable to employ an arrangement where an ink droplet is recorded on a recording medium and a dot diameter on the medium is measured.

Hereinafter, a recording method for compensating unrecorded portions caused by bad nozzles and a method for making the white streak inconspicuous are respectively explained in detail.

Compensation through Lightness

The below-mentioned examples are recording methods in which dots are compensated by different color nozzles instead of nozzles incapable of recording due to generated non-eject statuses or the like. Based on output data (hereinafter also referred as image data) corresponding to non-eject nozzles where non-eject statuses occur, compensated recording operations are executed by generating output data corresponding to compensating nozzles so that lightness of an image to be recorded with original output data matches lightness of an image to be recorded with other color nozzles used for compensation on a predetermined level. In order to match lightness of a uniformly recorded image by a compensating color to lightness of a uniformly recorded image by output data corresponding to the non-eject color on the predetermined level, output data corresponding to the color nozzles to be used for the compensation are generated. When unrecorded portions caused by non-eject statuses are recorded with other compensating colors after matching lightness on the predetermined level as mentioned above, it is possible to make non-eject portions inconspicuous.

It is desirable to select a compensating color having a chromaticity near that of the non-eject color. A color combination comprising cyan (hereinafter referred to as C), magenta (hereinafter referred to as M), yellow (hereinafter referred to as Y) and black (hereinafter referred to as Bk) is employed in ordinary color ink-jet printers. Among these colors it is possible to use M having nearly similar lightness to that of C or to use Bk having a relatively near lightness to that of C for compensating non-eject C nozzles. More specifically, data to be recorded by C nozzles are converted to M or Bk data so that a difference in lightness between C and M, or Bk is in a predetermined range, and converted M or Bk data are added to original M or Bk data and outputted.

Figure 2:
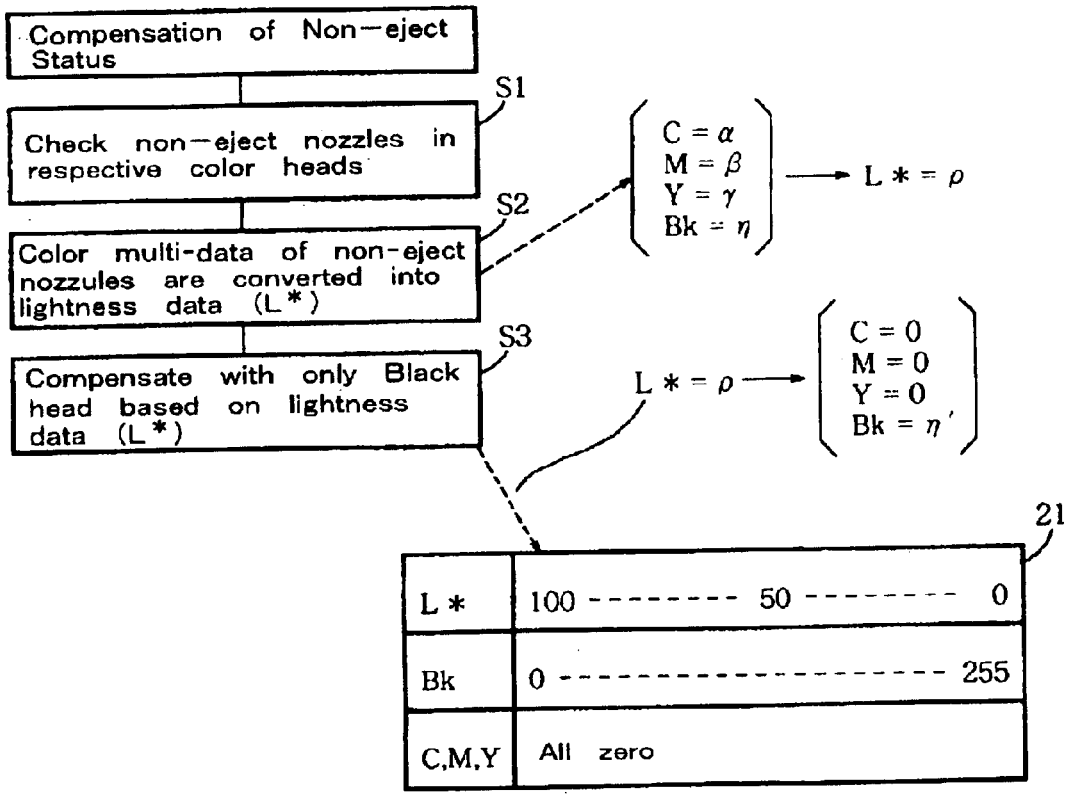
FIG. 2 is a block diagram showing a method for compensating non-eject nozzles of a recording head by using only black ink nozzles in all cases of low recording duty and high recording duty.

Even when non-eject statuses occur, it is possible to compensate non-eject statuses by executing compensating procedures shown in FIG. 2.

FIG. 2 is a block diagram/flow chart illustrating the above-mentioned compensation procedure by lightness. At first, a non-eject head and non-eject nozzles are recognized at step S1. More specifically, data on non-eject nozzles detected during manufacturing are written in an EEPROM beforehand and are readout afterward, non-eject nozzles are judged from an outputted image by a recording apparatus and non-eject nozzles are detected by a sensor.

Various detecting arrangements such as an arrangement to detect eject statuses of ink optically, an arrangement to detect non-eject portions by reading a tentatively recorded image and so forth are applicable to this detecting step. At step S2, output data (multi-data) on the non-eject color are read and data are converted to lightness (hereinafter also referred as L*) of the color. At step S3, data on a color to be used for compensating the non-eject color are generated based on corresponding lightness data of the non-eject nozzle. As mentioned above, the data for the compensation are generated so as to match the lightness to the predetermined level. At this step, a table where output data of respective colors and corresponding lightness of respective colors are stored can be used for converting output data corresponding to the non-eject color. A table 21 shown in FIG. 2 is a table used for the compensation by the black ink, which will be explained below.

The present inventors have found that an unrecorded portion b with width d in an image as shown in FIG. 1A is recognized as a white streak before the compensation, but when the unrecorded portion b is recorded by another compensating color, the recorded portion b is merged into surrounding colors by adjusting lightness of the compensating color near to that of an original color a, when the width d is sufficiently narrow even if the compensating color is different from the original color.

Figure 1B:
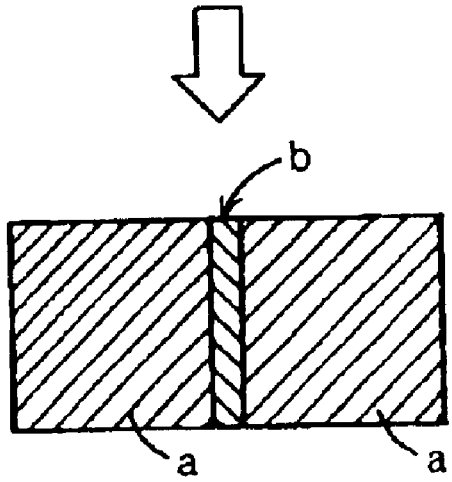
FIG. 1B is a schematic drawing showing a compensated defect shown in FIG. 1A.

FIG. 1A shows a state where the unrecorded portion b with the width d is generated in the image with the color a. FIG. 1B shows a compensated state where the unrecorded portion is compensated by another color so as to make its lightness near that of the original color. Experiments whether the unrecorded portion b without compensations and the compensated portion by another color, for example, by Bk, can be recognized as a nonuniformity or not were carried out by varying a distance between the image to be observed and the eyes of an observer.

An experimental example, where a red color with a lightness of about 51 is selected for the portion a in FIGS. 1A and 1B and the portion b in FIGS. 1A and 1B is compensated by varying the lightness of a gray color, is explained.

Figure 29A:
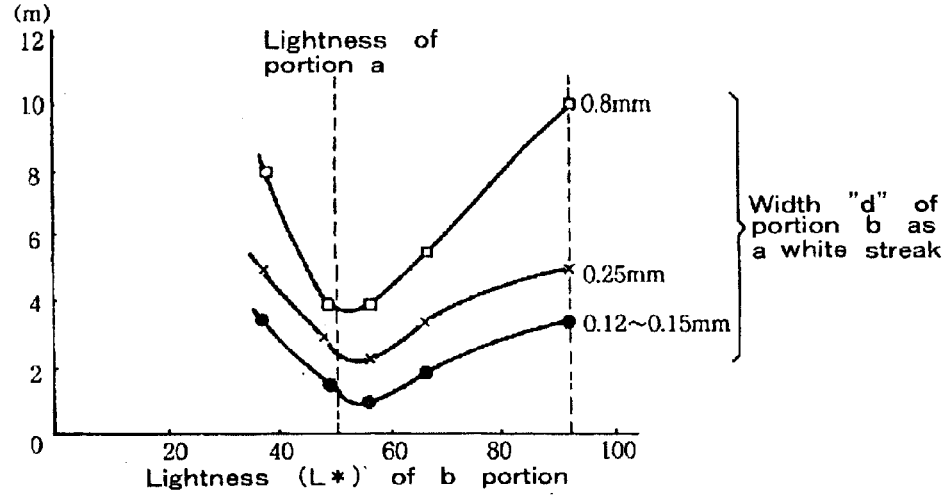
FIG. 29A is a graph showing a relation between brightness in compensated area b in FIG. 1B and distance of distinct vision of the compensated area b.

FIG. 29A is the graph where the axis of abscissa represents lightness (L*, lightness of the portion b) of compensating gray color and the axis of ordinate represents a range of clear vision, i.e., a distance from where nonuniformity in the compensated portion cannot be recognized.

In the experiment, coated paper (product No.: HR101) manufactured by Canon Kabushiki Kaisha (hereinafter referred to as Canon K.K.) is used as the medium to be recorded. One path recording on the coated paper is recorded by the ink-jet printer BJF850 manufactured by Canon K.K. The gray color is generated by mixing C, M, Y and Bk.

Intermediate gradation is generated by mixing three colors, C, M and Y, i.e., by a so-called process Bk, and high gradation is generated by adding Bk and gradually extacting C, M and Y. A process for generating the gray color employing color inks and black ink is executed by referring to a table corresponding to a selected gradation value.

From FIG. 29A it is understood that distances from where the white streak cannot be recognized (i.e., range of clear vision) are different from the lightness of the compensated portion of b. From curves depicted in FIG. 29A, it is deduced that distances from where the nonuniformity, such as the white streak and the like, cannot be recognized indicate smaller values, when the lightness of the portion b is near the brightness of the portion a, i.e., around 51.

It is also deduced from FIG. 29A that when the lightness of the portion b is set within a range of the lightness of the portion a ±10, the compensation is effective. The value ±10 corresponds to +20% of the lightness 51 of the portion a. Almost the same relations between two lightnesses are obtained when the lightness of the portion a is varied.

Preferably when the lightness of the portion b is set within a range of ±10% of the lightness of the portion a, compensation effects are raised.

It is also understood from FIG. 29A that when the width of portion b is smaller, a slightly greater lightness (a little bit brighter) of the portion b than that of the portion a makes the range of clear vision shorter. It is considered that this fact is caused due to dense color (lower lightness) at blotted and overlapped boundaries between portions of a and b.

Particularly since the gray color is formed by the above-mentioned process Bk, blotted areas are relatively spread.

In this case lightness of the white background of the medium is about 92.

Figure 29B:
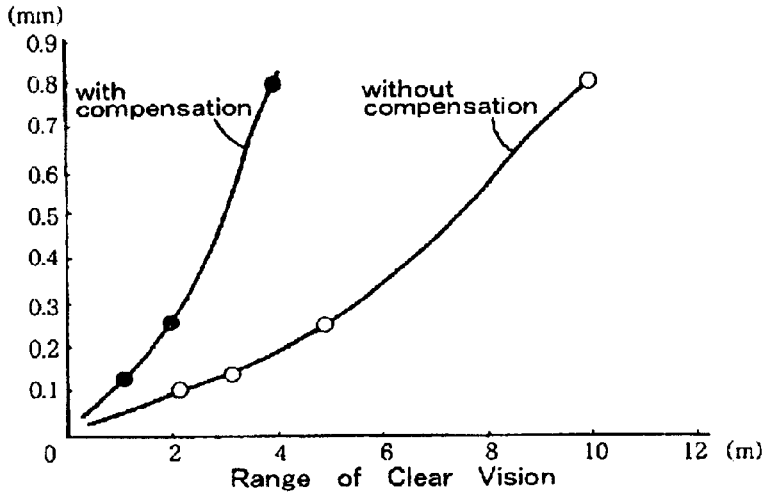
FIG. 29B is a graph showing a relation between distance of distinct vision and unrecognized defect width with and without compensation by minimum lightness (about 56) and FIG. 29C is an enlarged graph of a lowermost and leftmost portion of FIG. 29B

FIG. 29B is the graph depicting relations between the range of clear vision (axis of abscissa) and defect width (axis of ordinate) which cannot be recognized in a case of compensating with minimum lightness (about 56) in FIG. 29A and in a case without compensation.

Figure 29C:
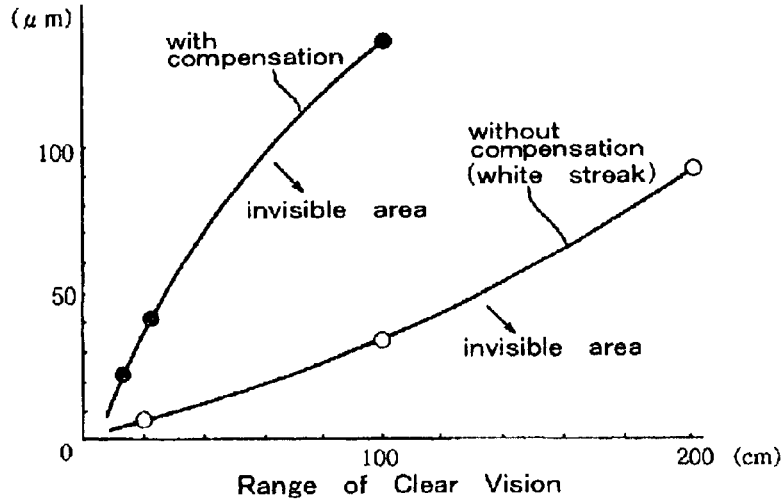

A lower portion around origin of the coordinates (i.e., lower defect width) in FIG. 29B is enlarged and shown in FIG. 29C.

A recognizable boundary of the defect width d is plotted in FIG. 29C as a curve with ○ (open circle) points. This curve indicates that when the defect width is about 30 μm, the defect cannot be recognized with the boundary value of distance 100 cm and when the defect width is about 5 μm, the defect cannot be recognized with the boundary value of distance 20 cm. In other words, it is concluded that when the defect with about a 30 μm width is observed from more than 100 cm, the defect cannot be recognized and when the defect with about a 5 μm width is observed from more than 20 cm, the defect cannot be recognized.

In a case where the defect portion b is recorded with compensating gray color so as to set the lightness at a predetermined level, the unrecognizable defect with width d shows a curve with ● (filled circle) points as plotted in FIG. 29C. This curve with filled circles indicates that when the defect with about a 130 μm width is observed from more than 100 cm, the defect can be hardly recognized, and even when the defect with about a 40 μm width is observed from more than around 20 cm, the defect can be hardly recognized. Consequently, when the defect is compensated with another color with the predetermined lightness, the defect portion is much less recognized than the case without compensation.

From the above-mentioned result, it is concluded that if the lightness of the portion b is set to a proper value and is compensated by another color, it is possible to make the white streak less recognizable.

The gray color employed in the above-mentioned experiments is formed by mixing C, M, Y and/or Bk inks, i.e., by the so-called process Bk. When the defect portion b is compensated by a thinned Bk dot pattern, almost the same results are obtained as the gray color compensation.

Figure 30B:
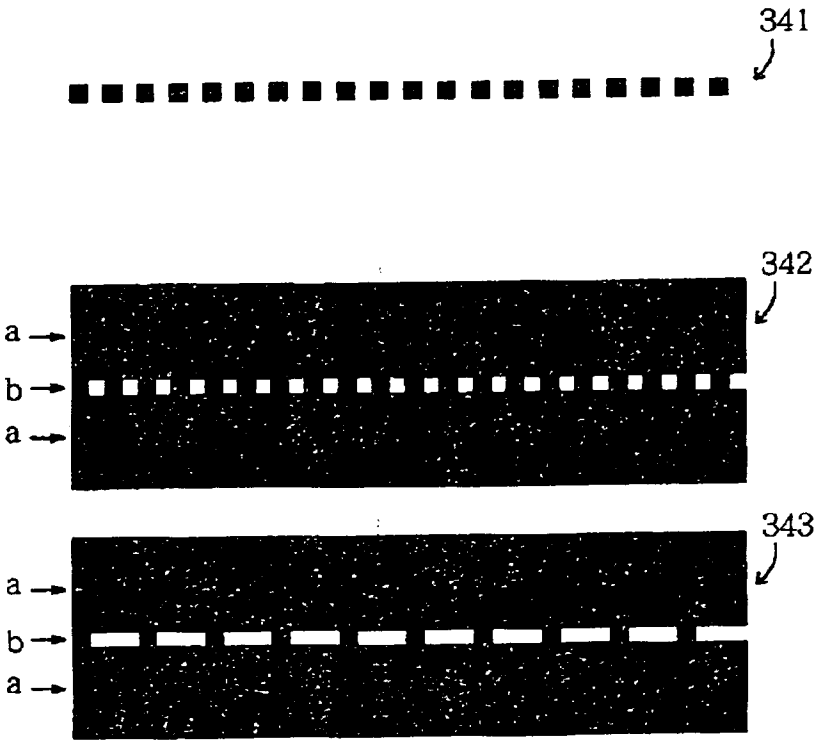
FIG. 30B is a drawing showing compensation examples of the defect portion b compensated by the thinned Bk dot patterns.

An example to compensate the defect portion b by the thinned Bk dot pattern is shown in FIG. 30B. A reference numeral "341" in FIG. 30B is a thinned Bk dot pattern. Reference numerals "342" and "343" are examples of compensated defect portion b by thinned Bk dot patterns.

Figure 30A:
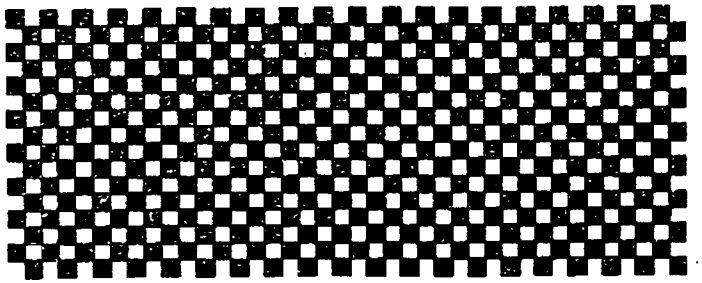
FIG. 30A is a drawing showing an enlarged thinned Bk dot pattern 341 in FIG. 30B.

The compensated portion b (the thinned Bk dot pattern) bearing no nonuniformity, an enlarged pattern of which is shown in FIG. 30A, is formed and the lightness of a predetermined area of the pattern is measured. When the measured lightness is compared with the lightness of the portion a, it is concluded that respective lightness values indicate close values to each other as indicated in the case by compensated gray color.

One of the reasons why Bk dot patterns are employed is that recorded portions with a high recording duty by another color including a secondary color with low lightness can be matched to thinned Bk dot patterns, since the lightness of the Bk dot per se is quite low.

Hereinafter a method of compensating a defect with a width d smaller than 200 μm is explained in detail.

In the compensating method, one pixel with a resolution of 1200×1200 dpi is formed by using a recording head with a resolution of 1200 dpi from which an ink droplet of about 4 pl is ejected and impacted on the coated paper HR101 manufactured by Canon K.K.

A uniform gradation pattern is formed with C ink so as to generate one non-eject portion by using non-eject free continuous nozzles and by adjusting an image to be recorded.

The non-eject portion is compensated with Bk ink dots.

As explained below, conditions on which the non-eject portion cannot recognized as a nonuniformity when observed from a certain distance are determined.

Figure 31A:
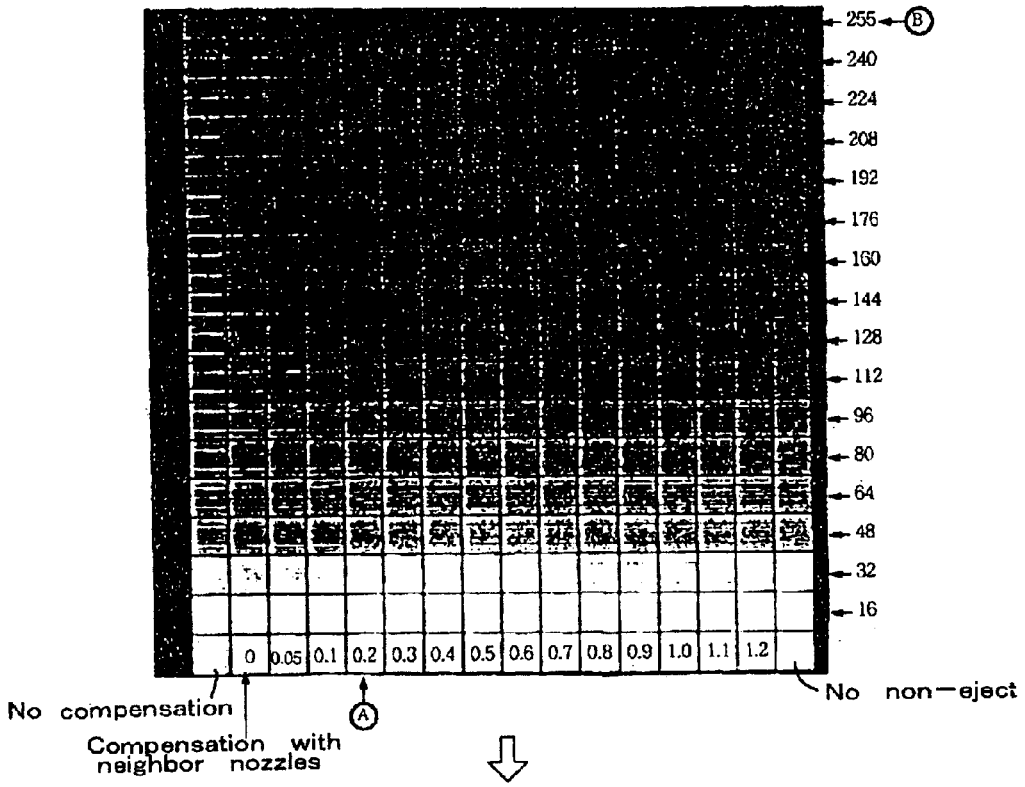
FIG. 31A is an example of a recorded pattern compensated by black ink dots from neighbor nozzles and FIG. 31B is a score table on non-uniformity of the recorded pattern in FIG. 31B.

In this method the pattern shown in FIG. 31A is recorded. Each grid is recorded such that it shows a uniform gradation, but with non-eject portions in it.

Several non-eject portions are scatteringly formed in each grid.

In FIG. 31A, in a vertical direction, gradation expressed in 8 bits in each grid is varied from 0 to 255. And in a horizontal direction, a coefficient to determine gradation of the compensating dot in each grid is varied from 0 to 1.2.

More specifically, when a coefficient value at a position of encircled A in the horizontal direction is 0.2 and when a gradation value at a position of encircled B is 255, a calculated gradation of a compensating dot is 255×0.2=51.

Figure 31B:
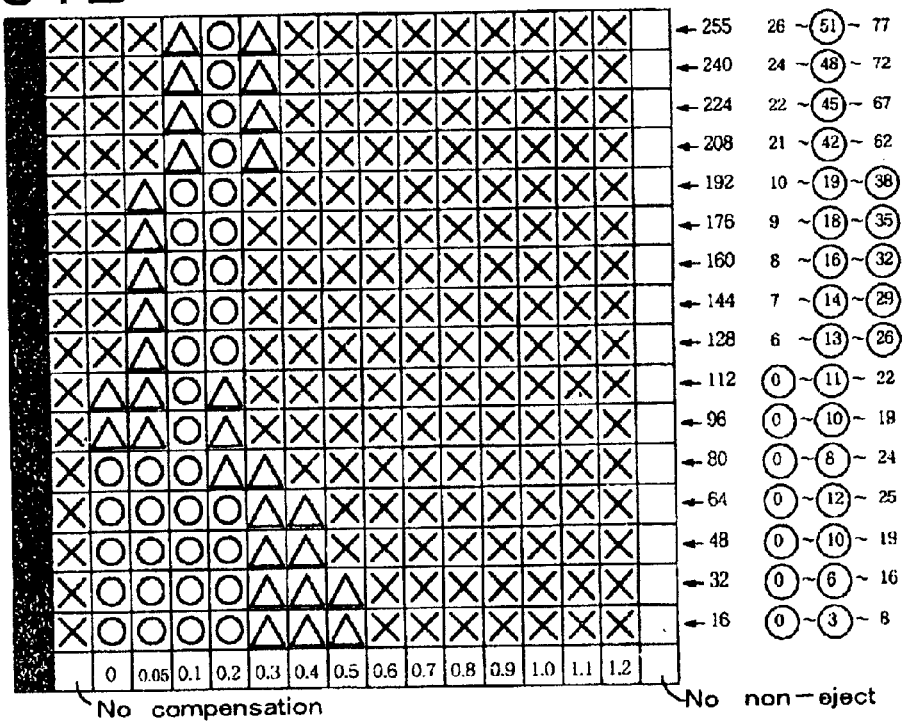

Since no nonuniformity is observed in a grid corresponding to the above-calculated position, it is marked ○ as shown FIG. 31B. Grids, in which it is difficult to judge whether nonuniformity is observed or not, are marked Δ. Grids where nonuniformity is observed are marked X.

FIG. 31B is completed when the above-mentioned evaluation procedure is repeated.

Figure 32:
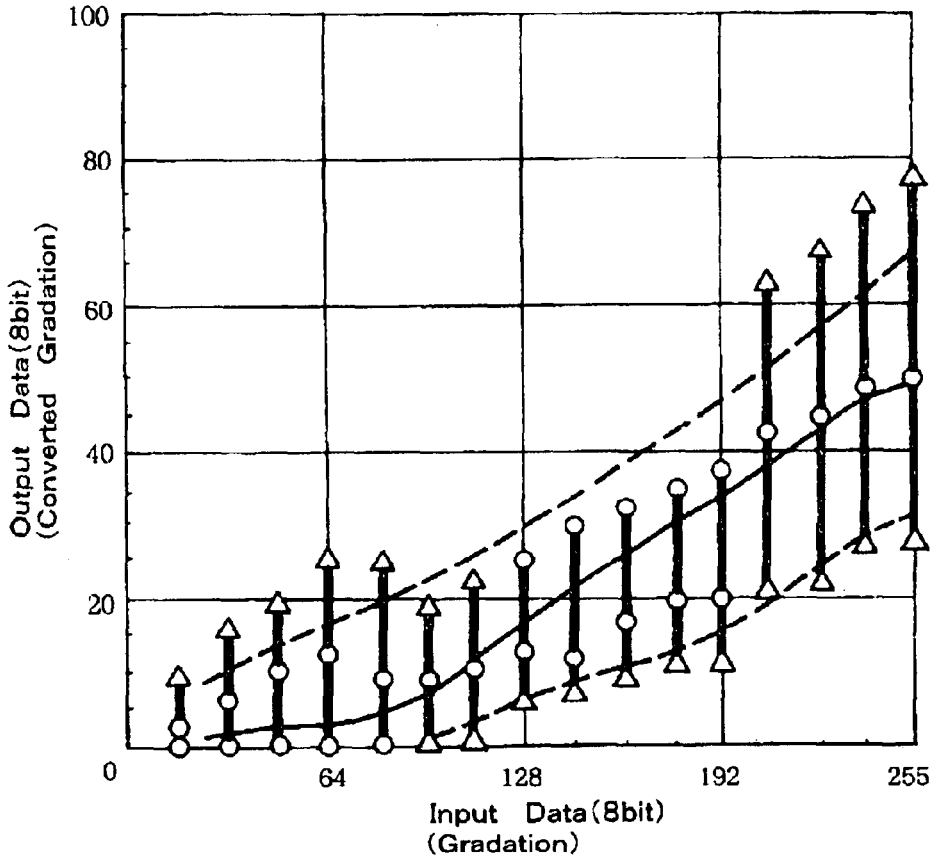
FIG. 32 is a graph based on the score table in FIG. 31B.

FIG. 32 is obtained based on the results of FIG. 31B.

In FIG. 32 results marked ○ and Δ are depicted, but results marked X are omitted.

Actually a compensation curve depicted with a solid line in FIG. 32 is obtained based on a more finely divided grid pattern than the pattern shown in FIG. 31A.

An area formed by two broken line curves sandwiching the solid line curve indicates the area where nonuniformity is inconspicuous.

Drawings shown in FIGS. 31A, 31B and 32 are examples of neighbor compensations by Bk carried out by raising multi-data of the nozzles next to a non-eject nozzle (or next neighbor nozzles) 1.5 times so that the number of dots from the next neighbor nozzles is raised 1.5 times.

Alternatively, the evaluation chart in FIG. 31B and the compensation curve in FIG. 32 can be produced by the following procedure. A similar test pattern to the pattern in FIG. 31A is recorded by a printing apparatus. The recorded pattern is read by a scanner, a sensor or the like arranged in the printing apparatus. The read pattern is evaluated so as to form an evaluation chart and a compensation curve respectively similar to FIG. 31B and FIG. 32. In this procedure, the sensor is defocused so as to adjust its sensitivity at the same level as human eyes and grids where white streaks or black streaks are distinctively recognized are removed and remaining intermediate grids are selected so as to form a compensation curve similar to that shown in FIG. 32.

Non-eject portions to be recorded by M ink are also compensated by Bk in the same way as the case of C ink explained in detail above.

As explained above, it is proved that white streaks due to non-eject statuses can be compensated by another color having near lightness to that of the original color and can be hardly recognized as streak nonuniformity, when non-eject widths are sufficiently narrow against the range of clear vision.

Based on the results of the experiments explained above, when lightness of the compensating color is set in a ±20% range of lightness of the original color, nonuniformity is improved at least before compensation (on the contrary black steaks do not become more conspicuous). Preferably, if the lightness of the compensating color is set in a ±10% range of lightness of the original color, the compensated results are remarkably improved.

In the above-explained examples, non-eject statuses are compensated by Bk ink, but can be compensated by other inks in the same way as the Bk ink.

When one non-eject status on the ordinary paper is compensated, multi-data of next neighbor nozzles are set 1.5 times so as to increase dot numbers recorded by the respective next neighbor nozzles; in other words, neighbor compensation is executed. No streaks are observed in the paper recorded with 400 dpi even without compensation by another color provided that permeability of the ink is high and the width of the defect portions is about 60 $\mu$m, since increased ink from neighbor nozzles blots to the non-eject portion. However, defect portions due to non-eject statuses are not always compensated completely, when ejected quantities from nozzles and dot diameters are small.

Taking the above-mentioned points into consideration, the compensation should be executed by adjusting ejected quantities from nozzles up to a status where nonuniformity is observed.

Hereinafter compensation cases when recording is executed on the coated paper with a small blotting rate, i.e., around 2 times, are explained. Since the blotting rate is small, the compensation by another color is executed.

Embodiments of Lightness Compensation by Using Bk Ink

Hereinafter a method to compensate non-eject nozzles by Bk dots is explained.

This method is based on adjusted image data such that lightness of image uniformly recorded by dots for compensation falls into a predetermined difference range from lightness of image to be recorded uniformly by non-eject nozzles.

It is preferable to compensate by a color with similar chromaticity to that of a color to be compensated. For example non-eject nozzles arranged in a head for cyan ink can be compensated by magenta or black ink so as to match lightness. However, boundaries of compensated portions are relatively conspicuous when compensated with magenta due to a difference in chromaticity between cyan and magenta. Therefore non-eject cyan nozzles are desirably compensated by Bk dots, if chromaticity is taken into consideration. Original data on lightness of C nozzles are converted to data on lightness of Bk nozzles so as to keep converted data within a predetermined lightness difference, and converted data are added to original data of Bk nozzles and outputted afterward.

An example of conversion from C to Bk is carried out as follows.

Figure 4:
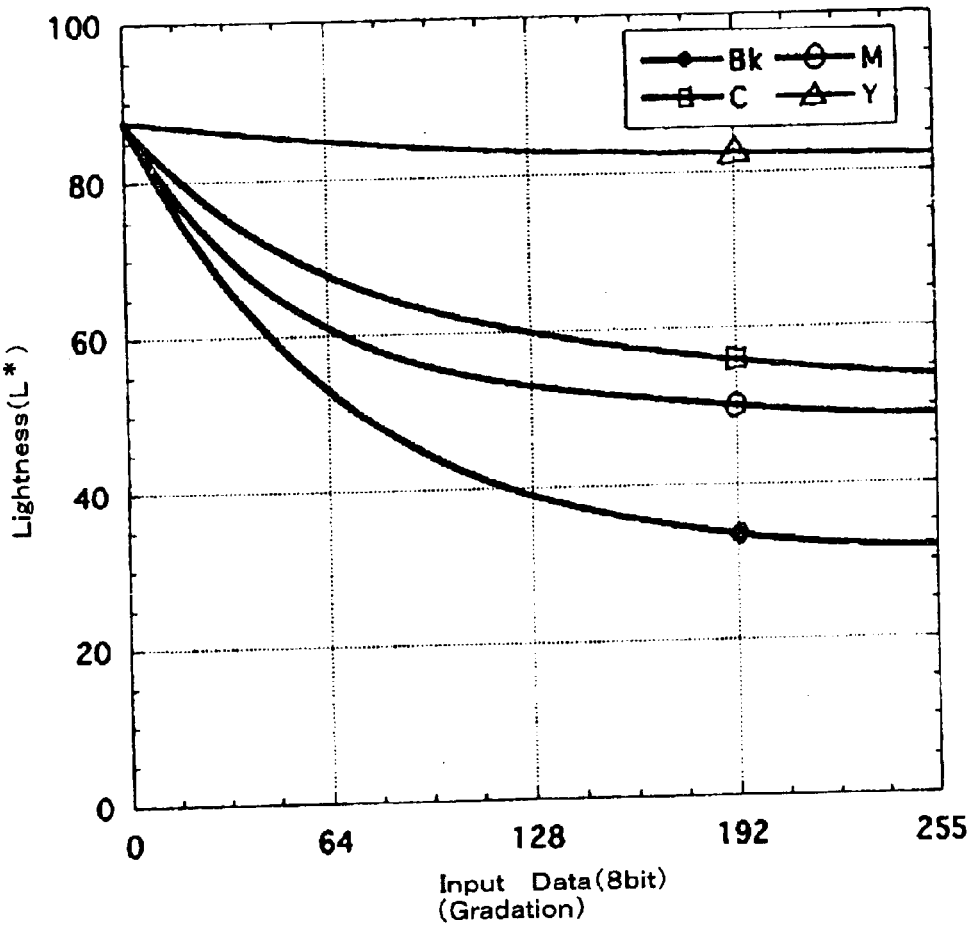
FIG. 4 is a graph showing a relation between input data and brightness (output data).

FIG. 4 is the graph showing relations between input data and lightness in respective inks recorded on a coated paper with a low blotting rate. The axis of abscissa represents input data in respective colors and the axis of ordinate represents lightness in respective colors.

From FIG. 4, lightness indicates about 56, when gradation of C is 192. While in order to obtain the same lightness value 56 in Bk, inputted gradation should be 56.

Consequently, from FIG. 4, it is concluded that when gradation data on non-eject cyan nozzles are 192, converted gradation data for black ink indicate 56.

Figure 5:
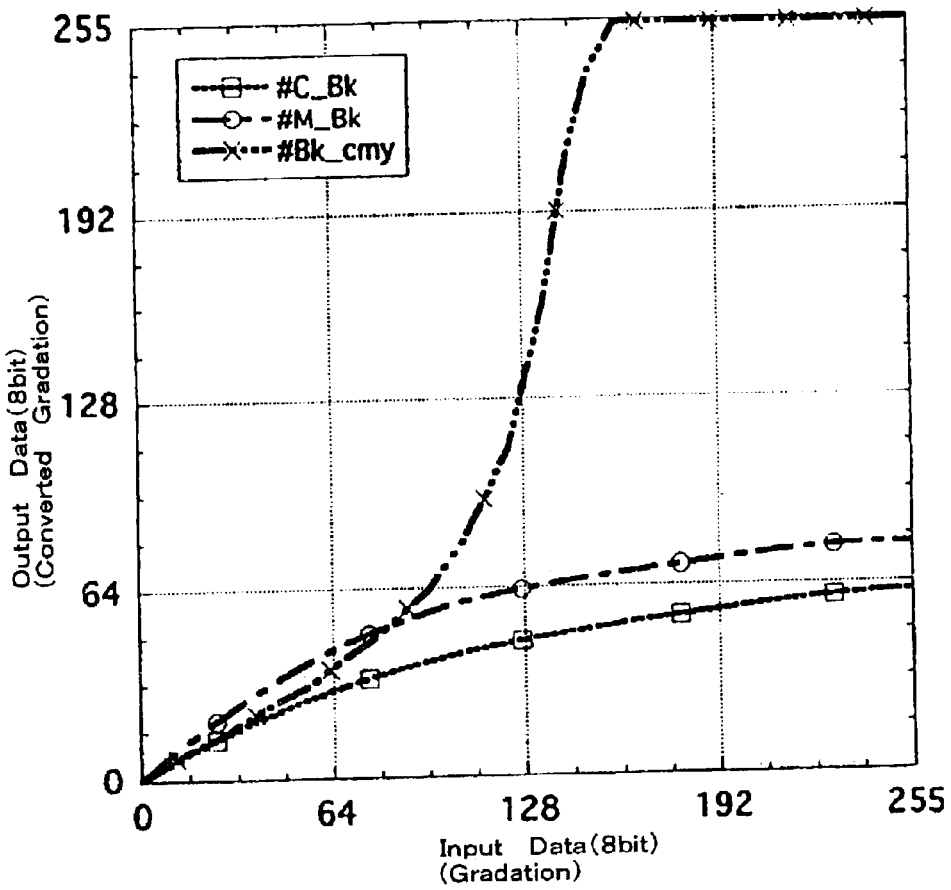
FIG. 5 is a graph showing conversion examples when recording defects are compensated by different colors.

In this way relations between C, M and Bk used for compensating are plotted in FIG 5. FIG. 5 is the graph showing relations between inputted data corresponding to non-eject nozzles and converted outputted data for compensation recording. In this drawing a curve designated by #C_Bk shows a relation of compensating cyan by black ink and another curve designated by #M_Bk shows a relation of compensating magenta by Bk ink. When defect portions caused by non-eject cyan or magenta are compensated by black ink, a table as shown in FIG. 5 is used so that influence by a non-eject color is reduced by outputting added converted Bk data corresponding to defect portions to the original Bk data. The lightness of Y against paper does not vary so much when its gradation is varied. In other words, since yellow is a quiet color, it is not necessary to compensate by another color. A curve designated by #Bk_cmy shows a relation of compensating Bk by three colors C, M and Y. Non-eject portions of Bk can be compensated by using C, M and Y.

Compensation by Head Shading

Hereinafter a method to make defect portions inconspicuous by a head shading treatment is explained. The head shading is a technique to compensate density nonuniformity mainly generated by fluctuating ejecting properties of respective plurality of nozzles, and to make density nonuniformity inconspicuous by determining correcting data to respective nozzles for equalizing densities. More specifically, a tentatively recorded image is read by a scanner and correction data are determined for raising densities of nozzles corresponding to low density portions in the read image or lowering densities of nozzles corresponding to high density portions in the read image, thus densities are equalized.

By executing the head shading treatment, corrections are made on areas corresponding to non-eject portions (defect portions) in the original image such that recording duties of at least neighboring peripheral pixels around the areas are raised, thus non-eject portions are made inconspicuous.

The head shading is the method for removing nonuniformity by modifying output $\gamma$ values (which will be explained in detail below) of respective nozzles according to density nonuniformity in a read test pattern recorded by the recording head. In ordinary resolution range from 400 dpi to 600 dpi, read data on density nonuniformity are corrected in such a manner that an averaged density calculated from that of a present nozzle and of its neighbor nozzles is considered as the corrected density of the present nozzle.

Since recorded densities corresponding to next neighbor nozzles to the non-eject nozzle are lowered, data of next neighbor nozzles are corrected so as to raise their densities by the head shading treatment.

The corrected dot number in a surrounding area of a pixel corresponding to the non-eject nozzle is raised to the similar dot number to a case without non-eject nozzles, as a result nonuniformity cannot be recognized.

FIGS. 3A to 3E are schematic drawings showing data correcting manners of neighbor nozzles to the non-eject nozzle by the head shading treatment.

Four dots are recorded in respective grids shown in FIGS. 3A to 3D, when recorded with 100% recording duty. On the other hand, in respective grids shown in FIG. 3E two dots are recorded, when recorded with 100% recording duty. Nozzles are arrayed in vertical directions in these respective drawings. An arrow "A" in respective drawings indicates a position not recorded due to the non-eject nozzle.

Figure 3A:
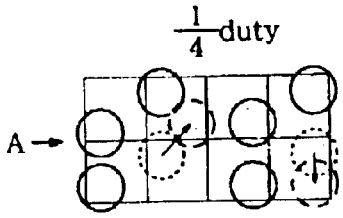
FIGS. 3A, 3B, 3C, 3D and 3E are schematic drawings for explaining non-eject dots and compensation methods in a case of an image formed by one dot per pixel.

FIG. 3A shows a schematic image to be recorded with ¼ recording duty, where data on neighbor nozzles to the non-eject nozzle are corrected to raise their density so that the dot number to be recorded are increased by the shading treatment. FIG. 3E shows a schematic image to be recorded with ⅛ recording duty. In low recording duties as mentioned above, streaks caused by non-eject nozzles are inconspicuous so that there are no significant differences between observed densities of corrected dot images and densities of images recorded by a normal recording head due to the increased dot number recorded by neighbor nozzles.

Figure 3B:
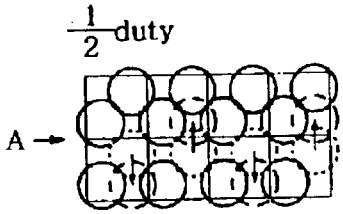
Figure 3C:
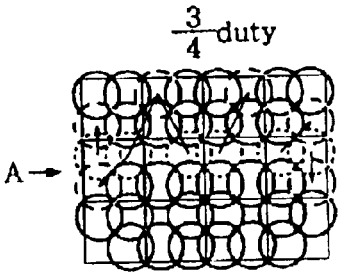
Figure 3D:
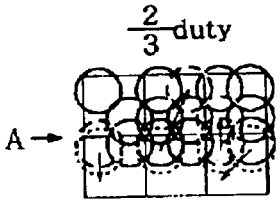
Figure 3E:
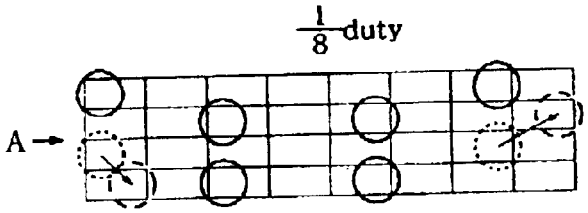

FIG. 3B shows a schematic image to be recorded with ½ (50%) recording duty and FIG. 3C shows a schematic image to be recorded with ¾ (75%) recording duty. Since the duty of the image shown in FIG. 3C is set high, density corresponding to the non-eject nozzle cannot be reproduced only by neighbor nozzles, so that data on second neighbor nozzles are corrected to raise their density.

As shown in FIGS. 3B and 3C, as dot densities to be recorded are raised, defect portions corresponding to non-eject nozzles (indicated by the arrow A) become gradually conspicuous as streaks.

Therefore the above-mentioned head shading treatment can effectively suppress density drops caused by defects in images due to non-eject statuses, when image areas with low duties are treated.

Figure 3F:
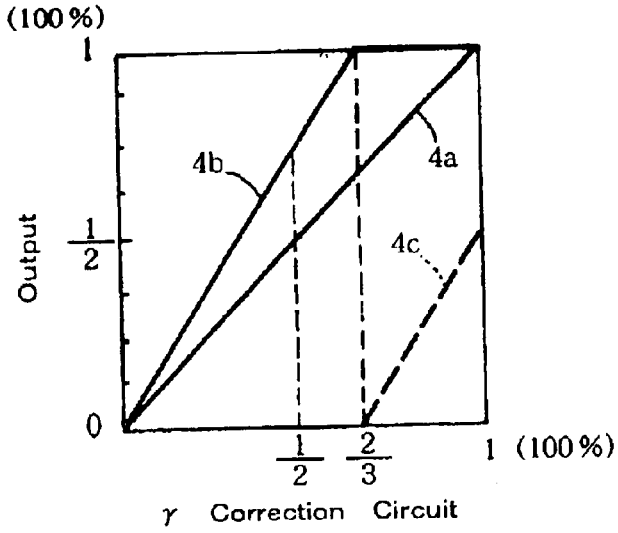
FIG. 3F shows an example of γ correction to neighbor nozzles of the non-eject nozzle judged by the head shading treatment.

FIG. 3F shows an example of γ correction to neighbor nozzles of the non-eject nozzle judged by the head shading treatment. Reference character "4*a*" is a gradient with no correction. Reference character "4*b*" is a gradient to raise the density 1.5 times by the γ correction. γ corrections against neighbor nozzles to the non-eject nozzle can be executed so as to raise the densities 1.5 times at the maximum.

As described above, in low recording duties the dot number in the vicinity of the non-eject nozzle is almost similar to that of the surrounding area when the uniform pattern is recorded. Even in high recording duties, when dots with a large diameter are recorded on a medium with a high blotting rate, recorded dots are blotted to the non-eject area so that nonuniformity can hardly be conspicuous.

Hereinafter, another recording example on the coated paper with a low blotting rate of about 2 times is explained. Since the blotting rate is low, the compensation by another color and the head shading treatment are executed together.

Combination of Lightness compensation with Head Shading Treatment

Here the above-mentioned two compensation methods are employed. Namely non-eject portions are compensated by using another color and next neighbor nozzles to the non-eject portions.

Hereinafter a more effective arrangement to correct defects in images caused by non-eject nozzles is explained by combining the method to compensate the defects with another color by adjusting its lightness with the head shading treatment.

It is preferable to adjust properly the above-mentioned respective compensation method in order to optimize the combined compensation method. As described above, in areas with low recording duties, the dot number in the vicinity of the pixel corresponding to non-eject nozzle and neighbor nozzles is almost similar to the dot number of the case without the non-eject nozzle; the vicinity of the pixel cannot be recognized as nonuniformity by the head shading treatment (see FIG. 3A and FIG. 3E).

However, in the head shading treatment when a solid area image is recorded with a high recording duty on a medium with low blotting rate, portions corresponding to non-eject nozzles tend to be white streaks and recognized as streaky nonuniformity. Therefore, when recorded with low recording duty, non-eject portions should be compensated by the head shading treatment and when recorded with high recording duty, non-eject portions should be additionally compensated by another color so that defect portions in the recorded image due to non-eject nozzles are suppressed regardless of differences of recording duties.

FIG. 3F shows a compensation example constituted by combining the head shading treatment with the compensation with another color. Neighbor nozzles to the non-eject nozzle are compensated according to the line 4*b* in FIG. 3F, and if a recording duty is high, defect portions corresponding to the non-eject nozzle are compensated by another color. The line 4*b* shows a γ compensation which raises image density up to 1.5 times. When the recording duty of image data exceeds ⅔ (67%), image data corresponding to another color are generated according to a line 4*c* in FIG. 3F. Thus, when recording duty is lower than ⅔, defect portions caused by non-eject statuses are made inconspicuous by raising image density in areas corresponding to neighbor nozzles to the non-eject nozzle, and when recording duty is higher than ⅔, compensation recording can be executed by another color so as to match lightness of non-eject portions to that of another color.

Hereinafter, based on compensation by the above-mentioned methods, a compensation procedure by an ink-jet recording apparatus is explained in detail.

The present invention can be executed by a printer having a function of a scanner or a printer capable of inputting density nonuniformity and data read from the pattern for measuring non-eject nozzles. Here, however, the compensation procedure is explained in the case of a color copy machine operable by an ink-jet method and capable of reading and recording color images.

First Embodiment

Hereinafter, a case where the coated paper with small blotting rate is identified by the color copying machine is explained.

Method Combining Lightness Compensation with Bk Compensation

The present embodiment is intended to compensate non-eject nozzles by using another color, particularly black (Bk) against cyan (C) and magenta (M) so as to match lightness of another color to that of a non-eject color based on image data corresponding to non-eject nozzles.

Hereinafter the preferred embodiment is explained by referring to the drawings.

Figure 9:
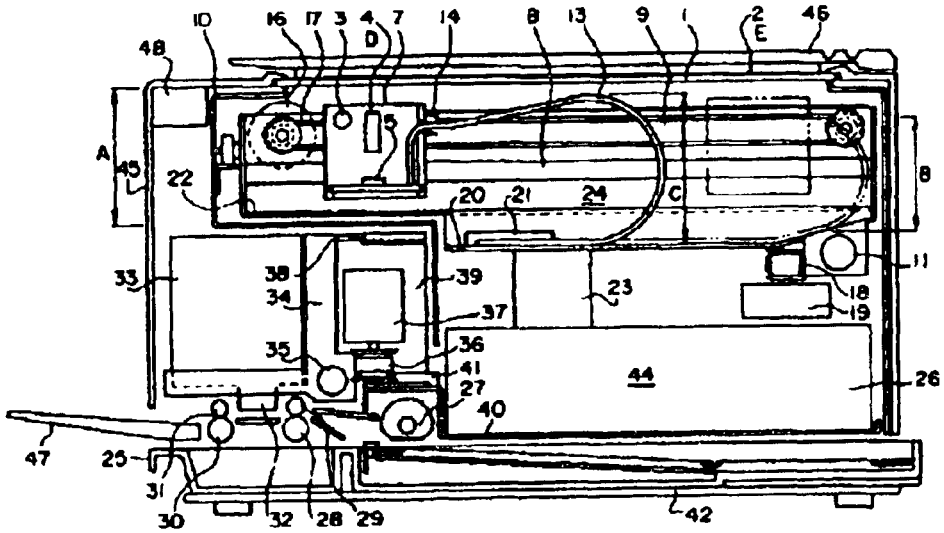
FIG. 9 is a side sectional view showing an arrangement of a color copying machine as an example of the inkjet recording apparatus of the present invention.

FIG. 9 is the side sectional view illustrating an arrangement of the color copying machine employing the ink-jet recording apparatus in the present embodiment.

This color copying machine is constituted by an image reading and an image processing unit (hereinafter referred to as a reader unit 24) and a printer unit 44. The reader unit 24 reads an image script 2 mounted on a script glass 1 via a CCD line sensor 5 having three color filters, R, G and B while being scanned. The read image is processed by an image processing circuit and the processed image is recorded on a paper or other recording media (hereinafter also referred as recording paper) by printer unit 44, namely by four color ink-jet heads, cyan (C), magenta (M), yellow (Y) and black (Bk).

Image data from outside can be inputted, and inputted data are processed by the image processing unit and recorded by printer unit 44.

Hereinafter, operational movements' of the apparatus are explained in detail.

The reader unit 24 is comprised of members or portions 1 to 23 and the printer unit is comprised of members or portions 25 to 43. A left upper side in FIG. 9 corresponds to a front face of the machine, to which an operator faces.

The printer unit 44 is equipped with an inkjet head (hereinafter also referred as a recording head) 32, which executes recording operations by ejecting inks. In the ink-jet head 32, for example, 128 nozzles for ejecting inks are arrayed and eject ports are formed at ejecting sides of nozzles. 128 eject ports are arranged in a predetermined direction (in a sub-scanning direction, which will be explained below) with a 63.5 $\mu$m pitch so that the recording head can record a width of 8.128 mm. Consequently when the recording paper is recorded, once a feeding operation (feeding in the sub-direction) of the recording paper is stopped, then the recording head 32 is moved in a perpendicular direction to FIG. 9 while the feeding operation is stopped. After the recording head records a desired distance with the width of 8.128 mm, the recording paper is fed by 8.128 mm and stopped and then the recording head starts recording. Thus, feeding operations and recording operations are alternatively repeated. The recording direction is called a main scanning direction and the paper feeding direction is called the sub-scanning direction.

In the constitution by the present embodiment, the main scanning direction corresponds to the perpendicular direction to the plane of FIG. 9 and the sub-scanning direction corresponds to the right/left directions in FIG. 9.

The reader unit 24 repeats reading the script image 2 by the width of 8.128 mm in response to the movements of the printer unit 44. Here a reading direction is called a main scanning direction and a feeding direction of the script image for the next reading is called a sub-scanning direction.

In the present constitution, the main direction corresponds to the right/left directions in FIG. 9 and the sub-scanning direction corresponds to the perpendicular direction to the plane of FIG. 9.

Hereinafter, operational movements of the reader unit are explained.

The script image 2 on the script mount glass 1 is irradiated by a lamp 3 mounted on a main scanning carriage 7, and the irradiated image is led to CCD line sensor 5 (photo sensor) via a lens array 4. The main scanning carriage 7 is fitted to a main scanning rail 8 mounted on a sub-scanning unit 9 so as to slide along the rail. The main scanning carriage 7 is connected to a main scanning belt 17 via a connecting member (not shown) so that it moves in the left/right directions in FIG. 9 by rotating a main scanning motor 16 for executing main scanning operations.

The sub-scanning unit 9 is fitted to a sub-scanning rail 11 fixed to an optical frame 10 so as to slide along the rail. The sub-scanning unit 9 is connected to a sub-scanning belt 18 via a connecting member (not shown) so that it moves in the direction perpendicular to the plane of FIG. 9 by rotating a sub-scanning motor 19 for executing main scanning operations.

Image signals read by CCD line sensor 5 are transmitted to the sub-scanning unit 9 via a flexible signal cable 13 capable of being bent in a loop. One end of the signal cable 13 is held (bitten) by a holder 14 on the main scanning carriage 7. Another end of the signal cable is fixed to a bottom surface 20 of the sub-scanning unit, by a member 21 and is connected to a sub-scanning signal cable 23 which connects the sub-scanning unit 9 to an electrical component unit 26 of the printer unit 44. The signal cable 13 follows movements of the main scanning carriage 7 and the sub-scanning signal cable 23 follows movements of the sub-scanning unit 9.

Figure 10:
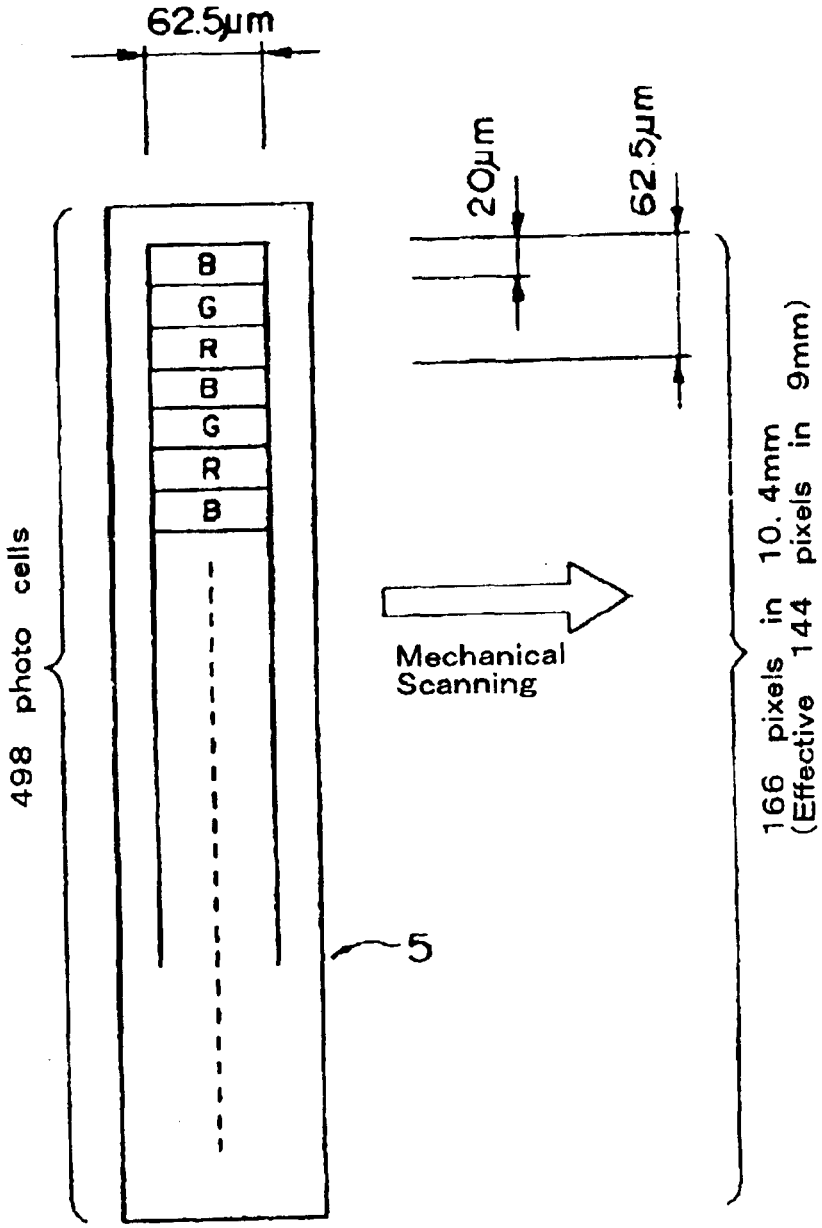
FIG. 10 is a drawing for explaining a CCD line sensor (photo sensor) in detail.

FIG. 10 is a detailed drawing of CCD line sensor 5 of the present embodiment. The line sensor 5 consists of 498 photo cells arrayed in a line and can read actually 166 pixels since each pixel requires three color elements, R, G and B. Among 166 pixels, the effective number of pixels is 144, which corresponds to a width of about 9 mm.

Hereinafter, operational movements of the printer unit 44 are explained.

Recording paper sent from a recording paper cassette 25 one by one by to a supply roller 27 driven by a power source (not shown) are recorded by a recording head 32 between two pairs of rollers, 28, 29 and 30, 31. The recording head is integrally formed with an ink tank 33 and demountably mounted on a printer main scanning carriage 34. The printer main scanning carriage 34 is fitted to a printer main scanning rail 35 so as to slide along the rail.

Further, since the printer main scanning carriage 34 is communicated to a main scanning belt 36 via a connecting member (not shown), the carriage is moved in perpendicular directions to the plane of FIG. 9 by rotating a main scanning motor 37 so that the main scanning is executed.

The printer main scanning carriage 34 has an arm member 38, to which a signal cable 39 for transmitting signals to the recording head 32 is fixed. Another end of the signal cable 39 is fixed to a printer intermediate plate 40 by a member 41 and further connected to the electric component unit 26. The printer signal cable 39 follows movements of the printer main scanning carriage 34 and is arranged such that the cable does not contact with the optical frame arranged above.

The sub-scanning of the printer unit 44 is executed by rotating the two pairs of rollers, 28, 29 and 30, 31 driven by the power source (not shown) so that the recording paper is fed by 8.128 mm. A reference numeral "42" is a bottom plate of the printer unit 44. A reference numeral "45" is an outer casing. A reference numeral "46" is a pressure plate for pressing the image script against the image script mounting glass 1. A reference numeral "1009" is a paper discharging opening (see FIG. 22), A reference numeral "47" is a discharged paper tray and a reference numeral "48" is an electrical component unit 48 for operating the copy machine.

Figure 11:
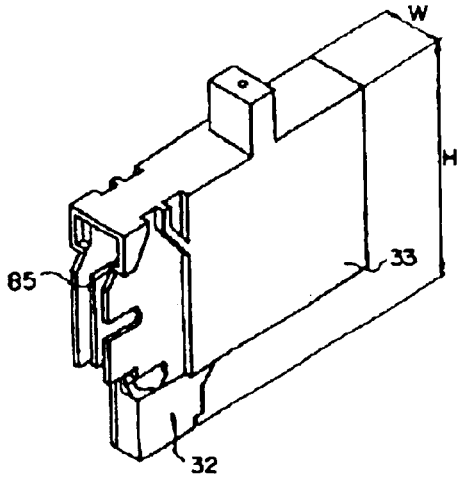
FIG. 11 is a perspective outline view of an ink-jet cartridge.
Figure 12:
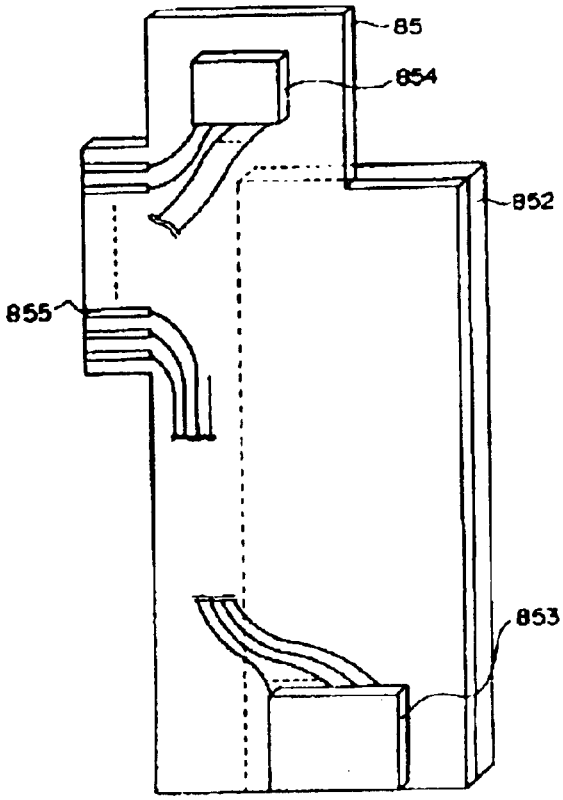
FIG. 12 is a perspective view showing a printed circuit board 85 in detail.

FIG. 11 is the perspective view illustrating an external appearance of an ink cartridge arranged in the printer unit 44 of the present embodiment. FIG. 12 is the perspective view illustrating the printed circuit board 85 shown in FIG. 11 in detail.

In FIG. 12, a reference numeral "85" is the print circuit board. A reference numeral "852" is an aluminum radiator plate. A reference numeral "853" is a heater board consisting of a matrix of heating elements and diodes. A reference numeral "854" is a memory means where information on respective nozzles is stored. For the memory means, a non-volatile memory, such as an EEPROM or the like, is employable in accordance with situations.

In the present embodiment, information as to whether respective nozzles are a non-eject nozzle or not is stored, but it is possible to store other information such as density nonuniformity and the like.

A reference numeral "855" is a contact electrode connected to the printer unit of the copying machine. Arrayed nozzle groups are not shown in FIGS. 11 and 12.

Figure 13A:
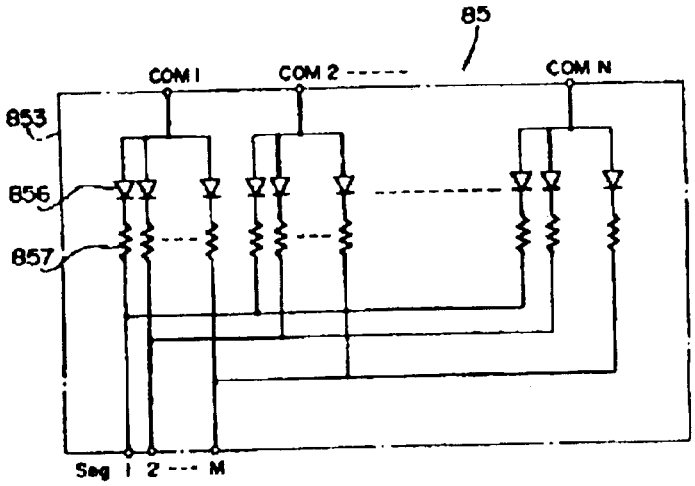
FIGS. 13A and 13B are drawings showing main circuit components of the printed circuit board 85.
Figure 13B:
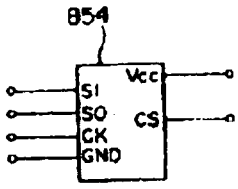
Figure 14:
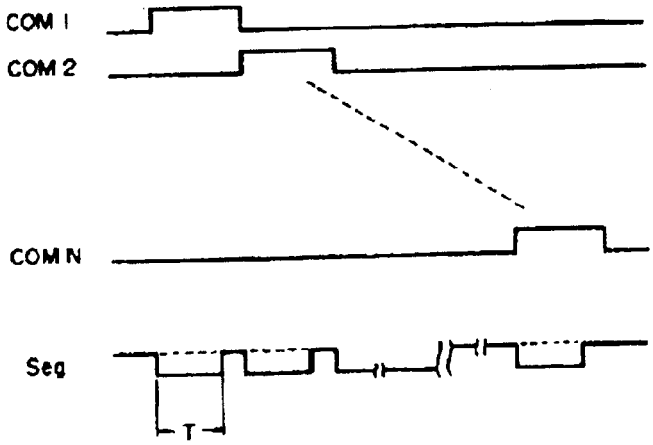
FIG. 14 is an explanatory drawing showing an example of a time sharing driving chart for heating elements 857.

When the recording head is mounted to the printer unit of the copying machine, the printer unit reads information on non-eject nozzles from the recording head 32 and controls the recording head based on the read information so as to improve density nonuniformity. Thus good image quality can be maintained FIGS. 13A and 13B show arrangement examples of main portions of a circuit on the printed circuit board 85 shown in FIG. 12. FIG. 13A shows a circuit arrangement of the heater board 853, which consists of an N×M matrix structure where respective heating elements 857 and respective diodes 856 for preventing rounded electric current are connected to each other in series. These heating elements 857 are allocated into N blocks and each block consists of M heating elements. Respective blocks are activated one after another according to a time sharing schedule as shown in FIG. 14. Quantities of energy to activate respective blocks are controlled by varying applied pulse widths (T) to the segment side (in FIG. 13A referred to as Seg).

FIG. 13B shows an example of the EEPROM 854 shown in FIG. 12. In the present embodiment, information on non-eject nozzles is stored in the EEPROM and outputted to the image processing unit of the copying machine.

Figure 17:
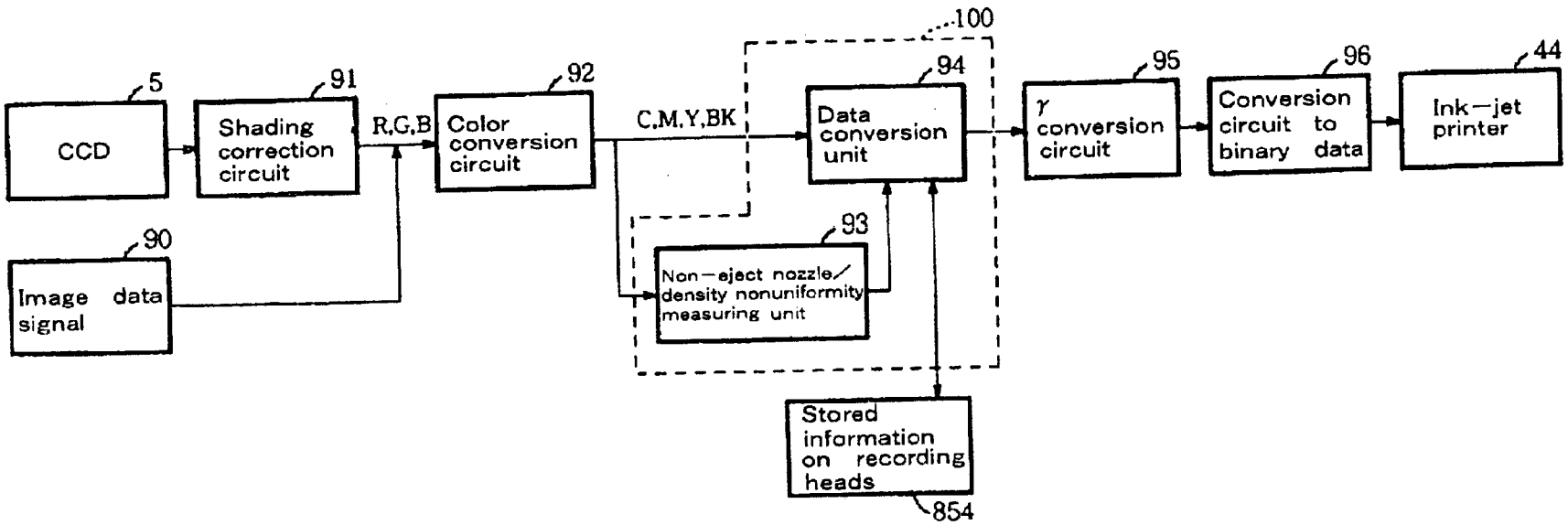
FIG. 17 is a block diagram showing an arrangement of an image processing unit of the present embodiment.

An example of the constitution of the image processing unit in the present embodiment is shown in FIG. 17.

In FIG. 17, image signals read by the CCD sensor 5, as one of solid state image sensors, are corrected as to their sensor sensitivities by a shading correction circuit 91. Corrected signals of three primary colors of light, R (Red), G (Green) and B (Blue), are converted to signals of colors for recording, C (cyan), M (Magenta), Y (Yellow) and Bk (Black), by a color conversion circuit 92.

Usually the color conversion is executed by utilizing a three dimensional LUT (Look Up Table), but is not limited to the LUT. It is also applicable to colors for recording comprising low density LC (Light Cyan), LM (Light Magenta) or the like in addition to C, M, Y and Bk.

Image data acquired outside can be directly inputted to the color conversion circuit 92 and be processed there.

C, M, Y and Bk signals converted from RGB signals are inputted to a data conversion unit 94. Inputted signals are converted as mentioned below by utilizing the information on non-eject nozzles stored in the memory means arranged in the inkjet recording head or information acquired by calculation based on measured data of non-eject nozzles, and supplied to a γ conversion circuit 95. Properties on respective nozzles used here are stored in a memory of the data conversion unit 94.

Figure 18:
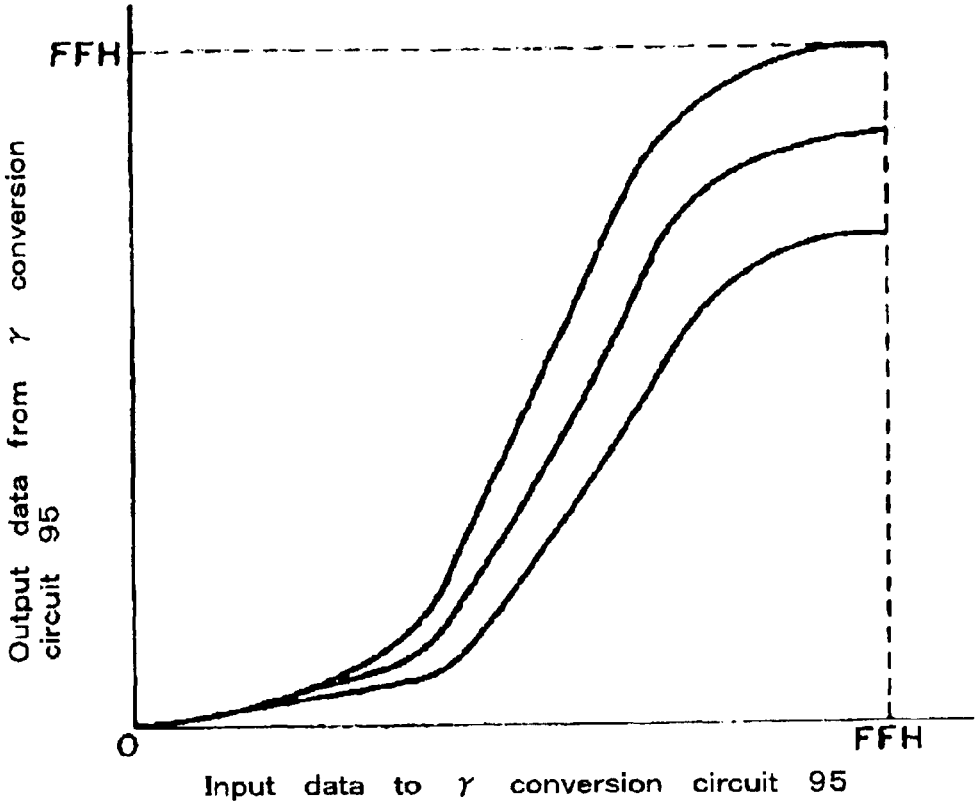
FIG. 18 is a graph showing a relation between input and output data in a γ conversion circuit 95.

The γ conversion circuit 95 stores several staged functions, for example, as shown in FIG. 18 for calculating output data from input data. Stored functions are properly selected based on density balances in respective colors and color taste of users. These functions are also determined based on properties of inks and recording papers. The γ conversion circuit 95 can be incorporated into the color conversion circuit 92. Output data from the γ conversion circuit are transmitted to a conversion to binary data circuit 96.

In the present embodiment, an error diffusion method (ED) is employed for converting transmitted data to binary data.

Outputted data from the conversion circuit 96 to binary data 96 are transmitted to the printer unit and recorded by the recording head 32.

The present embodiment utilizes the conversion circuit to binary data for outputting image data, but is not limited to this conversion circuit. For example, a conversion circuit to tertiary data for utilizing large/small dots or a conversion circuit to n+1th data for utilizing 0 to n dots can be also selected depending on various outputting methods.

Hereinafter, a non-eject nozzle/density nonuniformity measuring unit 93 and a data conversion unit 94, which constitute a data processing unit 100, are explained.

Figure 19:
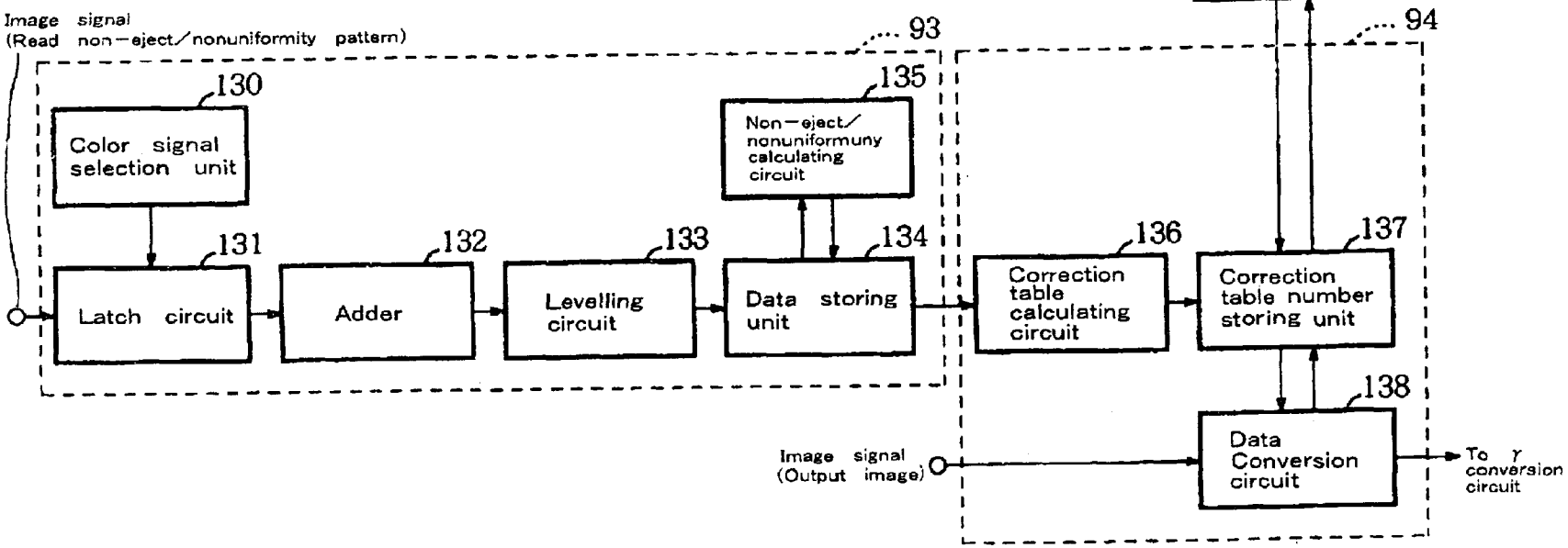
FIG. 19 is a block diagram showing an arrangement of a main portion of a data processing unit 100 for explaining its functions.

FIG. 19 is the block diagram showing a constitution of main portions of the data processing unit 100 in FIG. 17, where portions surrounded by broken lines are respectively the non-eject nozzle/density nonuniformity measuring unit 93 and the data conversion unit 94.

To begin with, detailed functions of the non-eject nozzle/density nonuniformity measuring unit 93 are explained.

In this unit, if information on non-eject nozzles is required to be renewed, operations for printing the non-eject/nonuniformity pattern, reading the printed pattern and processing data are executed. If information on non-eject/nonuniformity is not required to be renewed, the above-mentioned operations can be omitted.

In the present embodiment, corrections on density nonuniformity are not executed, but the non-eject nozzle/density nonuniformity measuring unit 93 can acquire information on the density nonuniformity. However, the acquired information is used in other embodiments, and operations for acquiring the information is also explained.

When the information on non-eject nozzles is renewed, a recovery operation of the recording head is executed prior to printing the non-eject/nonuniformity pattern for reading. The recovery operation, consisting of a series procedures for removing ink stuck to the recording head 31, for removing bubbles by sucking ink from nozzles and for cooling head heaters, is very desirable as a preparing operation for printing the non-eject/nonuniformity pattern for reading on best conditions.

Figure 23:
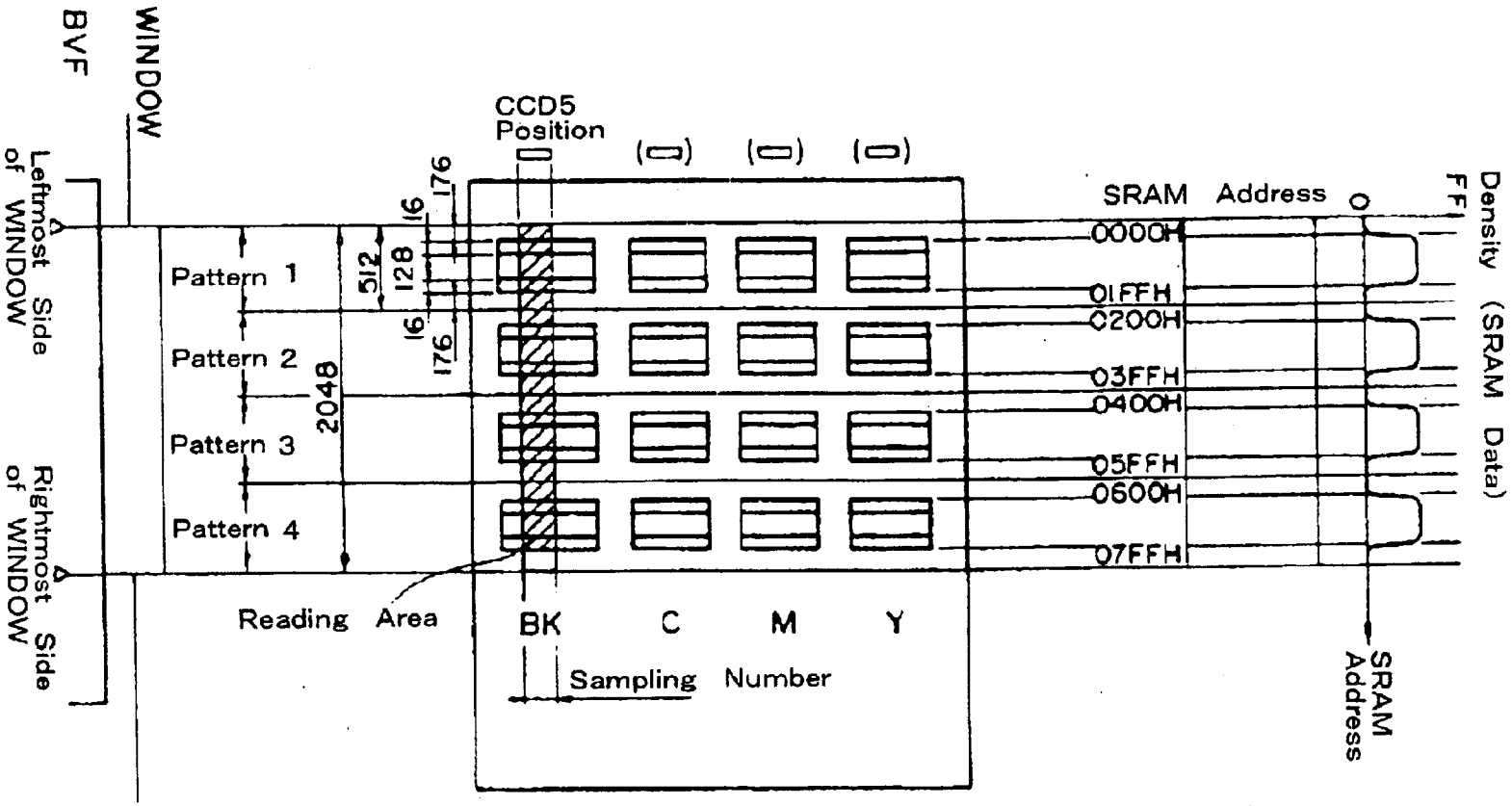
FIG. 23 is an explanatory drawing showing recorded output status of a nonuniformity pattern for reading.

Then the non-eject/nonuniformity pattern for reading shown in FIG. 23 is outputted as a recorded pattern. In the recorded pattern four rows of respective color blocks are recorded at 50% half tone in a vertical direction in FIG. 23, and as a result 16 blocks are recorded in total. The patterns are recorded at predetermined positions on the recording paper. Each block consists of 3 lines of recording where the first and third lines are recorded by using uppermost and lowermost 16 nozzles, respectively, and the second line is recorded by using 128 nozzles; consequently, each recorded block at the half tone has a width corresponding to 160 nozzles. Reasons for recording each block with the width corresponding to 160 nozzles are as follows.

Figure 24:
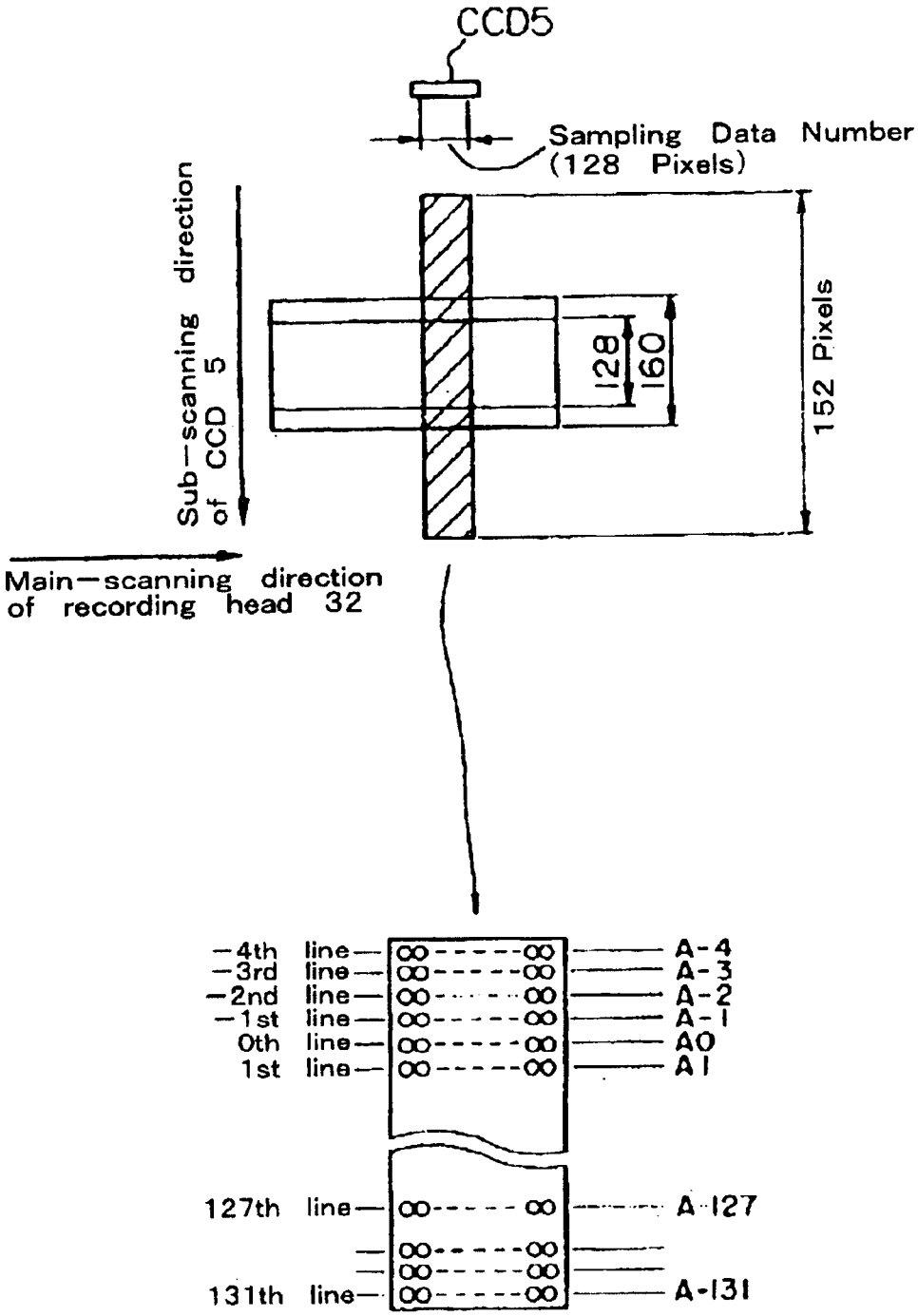
FIG. 24 is an explanatory drawing showing a recorded pattern by the recording head having 128 nozzles.

As shown in FIG. 24, when the pattern recorded by the recording head 32 consisting of, for example, 128 nozzles is read by the CCD sensor 5 or the like, density data An tend to be blunted by the influence of a background color (for example, white) of the recording paper. Consequently, if each block is recorded with only 128 eject ports, there are possibilities to lose reliabilities in density data of eject ports at both sides of the recording head. In this embodiment, so as to avoid such possibilities, the pattern is recorded with 160 eject ports and density data having values more than a predetermined threshold value are treated as effective data. An eject port corresponding to one density data in the center of the effective data is considered as the center eject port. Density data positioned (the total eject port number)/2 (=64 in this case) apart from the center to right/left are considered data corresponding to the first eject port and 128th eject port respectively.

The nozzle number employed for recording the first and third lines of each block is not always limited to 16. In this embodiment, in order to save data storing memory, the nozzle number is 16.

Figure 22:
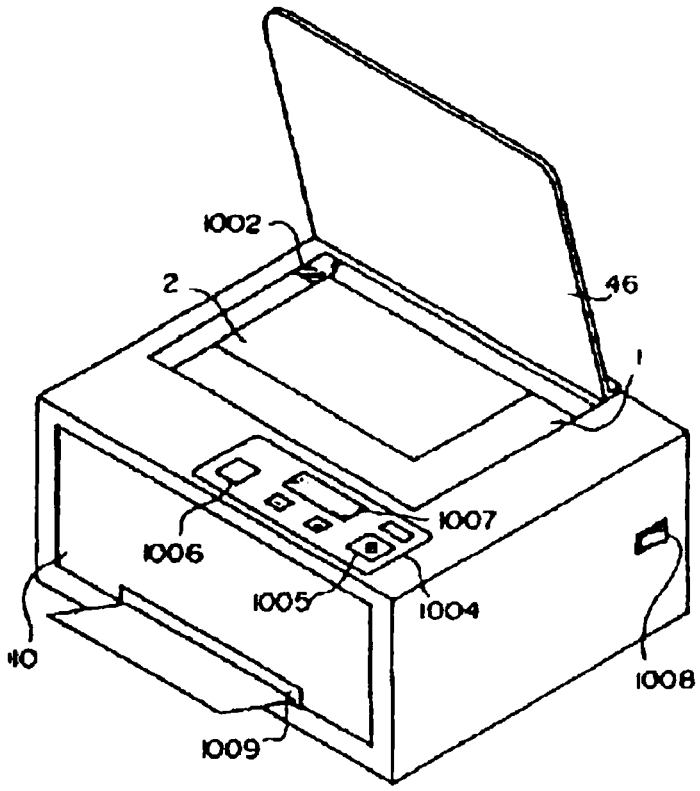
FIG. 22 is a perspective outline view of the main body an ink-jet recording apparatus.

After the non-eject/nonuniformity pattern for reading is recorded, as shown in FIG. 22 an outputted recording paper 2 is placed on the script glass 1 with its recorded surface being faced downward so as to align recorded 4 blocked color rows in the main scanning direction of the CCD sensor 5. Then a reading operation to read the recorded pattern is started.

Figure 25A:
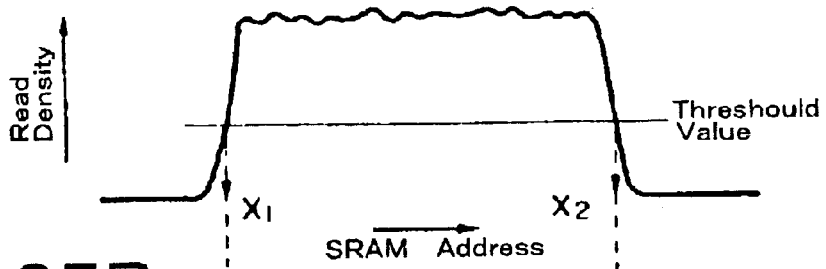
FIGS. 25A, 25B and 25C are explanatory drawings showing read recorded density curve patterns.
Figure 25B:
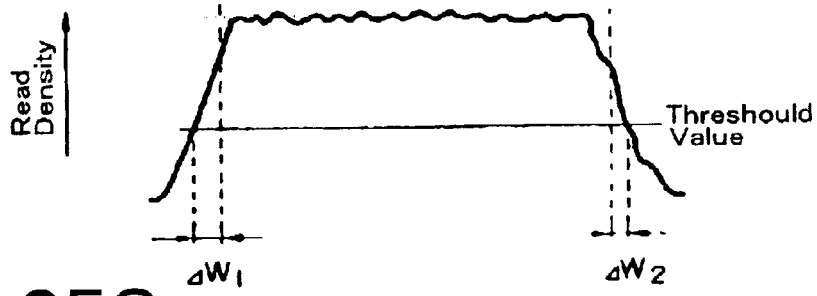

Prior to reading the non-eject/nonuniformity pattern for reading, a shading treatment against the CCD sensor 5 is executed by using a standard white plate 1002 shown in FIG. 22. Here "one line" is defined as one main scanning over 4 blocked color rows. When one line is read, read density data corresponding to 4 blocked color rows, for example, a black pattern, are stored in an SRAM (see FIG. 23). Respective color blocks are recorded at predetermined positions so that read data (density data) on respective 4 blocked colors are stored in a predetermined area of the SRAM. A profile of the read data usually shows a curve shown in FIG. 25A. In the figure, a horizontal direction represents an SRAM address and a vertical direction represents density. As mentioned above, the recorded area is defined as an area with a density more than the determined density level (threshold). Here an address X1, corresponding to a first address of which density exceeds the threshold value, is checked as to whether the address is in an allowable range. In the same way an address corresponding to a last address, of which density exceeds the threshold value, is defined as "X2". When a starting address of reading is defined as "X", whether X1 is in a range of X+Δx or not is checked and also whether data corresponding to addresses is in a range of X1+160Δx or not is checked.

When conditions mentioned above are not fulfilled, the reading operation is judged as an error caused possibly by placing the pattern for reading obliquely. The reading operation is executed again or read data are checked again after a rotating calculation is executed on the read data. Thus, respective density data are matched to corresponding nozzles. Density data for each pixel in a range from X1 to X2, which is judged as the recorded area, is checked as to whether the density exceeds a threshold value for judging a non-eject nozzle or not.

Figure 25C:
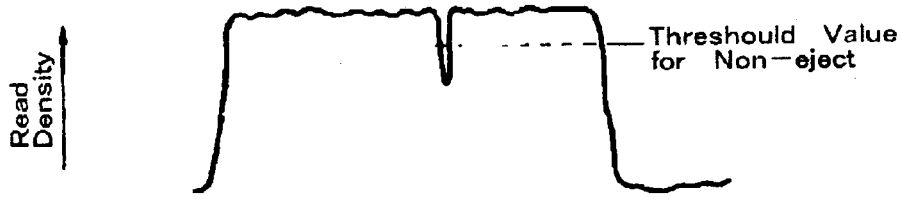

When only one nozzle is judged as the non-eject nozzle as shown in FIG. 25C, usually the density of the judged nozzle is not lowered to the level of the background color of the recording paper. Taking this fact into consideration, the threshold value for judging the non-eject nozzle is set separately and when data in the recording area have lower values than the threshold value, corresponding nozzles are judged as non-eject nozzles.

When the recording head is in unstable statuses, sometimes eject ports are brought to non-eject statuses abruptly.

For example, when non-eject statuses occur in four recording patterns shown in FIG. 23, it is judged as a perfect non-eject status. If there are no non-eject statuses except in one area, the non-eject statuses are judged as unexpected ones, which may be excluded for calculation, or judged as an error and the recording operation may start again, instead. The threshold value for judging the non-eject status is not necessarily set separately, but if the threshold value for judging the recorded area is set at higher level a little bit of both non-eject statuses and the recorded area can be checked simultaneously.

Data processed in the above-mentioned way are inputted to a non-eject/nonuniformity calculating circuit 135 (in FIG. 19).

Calculations in the present embodiment are executed to determine non-eject nozzles, and calculations to determine a density ratio for correcting nonuniformity are also explained.

Figure 26:
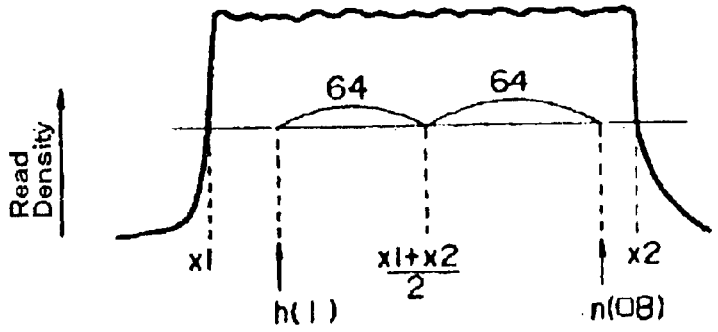
FIG. 26 is an explanatory drawing showing a relation between a recorded density curve pattern and nozzles.

After data in the form of a curve shown in FIG. 25C are inputted, succeeding procedures are explained by referring to FIG. 26. An average value of data at both sides, X1 and X2, is calculated and a center value of the recording area is determined. The determined center is judged as a space between 64th and 65th nozzles. Therefore 64th pixels from the center to the right/left correspond, respectively, to the first nozzle and the 128th nozzle. Thus recording densities n(i) correspond to respective nozzles including connecting nozzles to both side nozzles. When recording densities n(i) for respective nozzles are lower than the threshold value for detecting a non-eject nozzle, corresponding nozzles are determined as non-eject nozzles and the density ratio information of the determined nozzles is set as d(i)=0. Since calculations on the density ratio are not executed in the present embodiment, density ratio information on remaining nozzles are set as d(i)=1.

The density ratio information can be determined as follows.

An average value AVE of total nozzles except non-eject nozzles is calculated and the density ratio d(i) for respective nozzles is defined as d(i)=n(i)/AVE.

Figure 27:
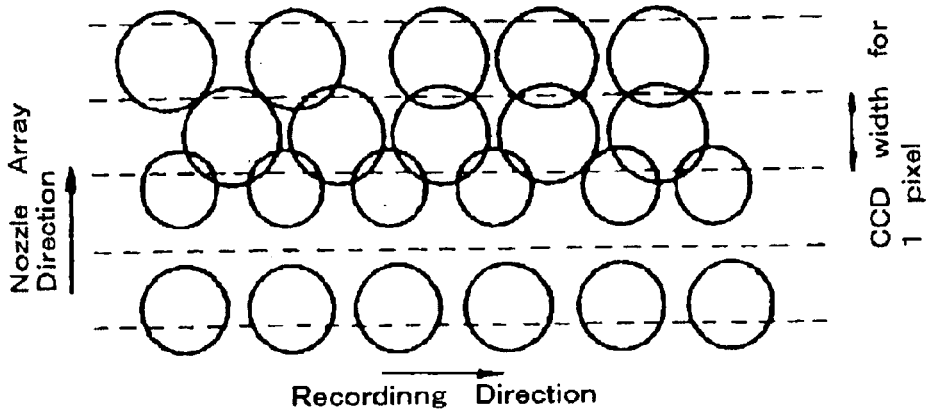
FIG. 27 is a drawing for explaining statuses of pixels in an area to be read.
Figure 28:
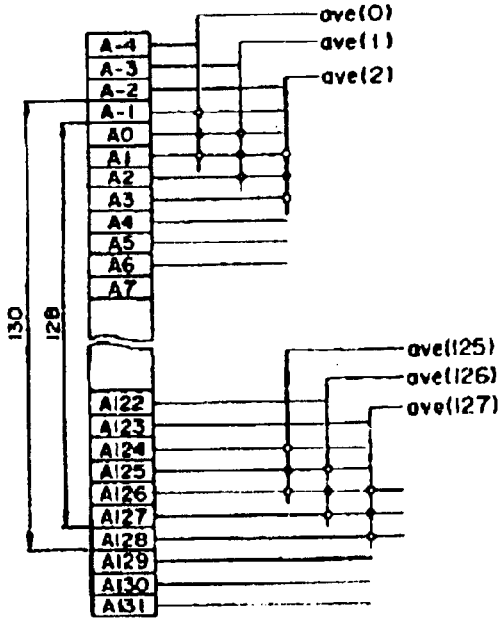
FIG. 28 is a drawing for explaining data of pixel density.

It is not desirable to use density data corresponding to an area with one pixel width as it is. Because, as shown in FIG. 27, a read area corresponding to one pixel certainly includes densities from dots ejected from nozzles at both sides and it is natural that any nozzle deviates a little toward a right or left nozzle. In addition, when calculations are executed, it should be considered that density nonuniformity of a pixel observed with human eyes is influenced by surrounding conditions around the pixel.

Figure 8:
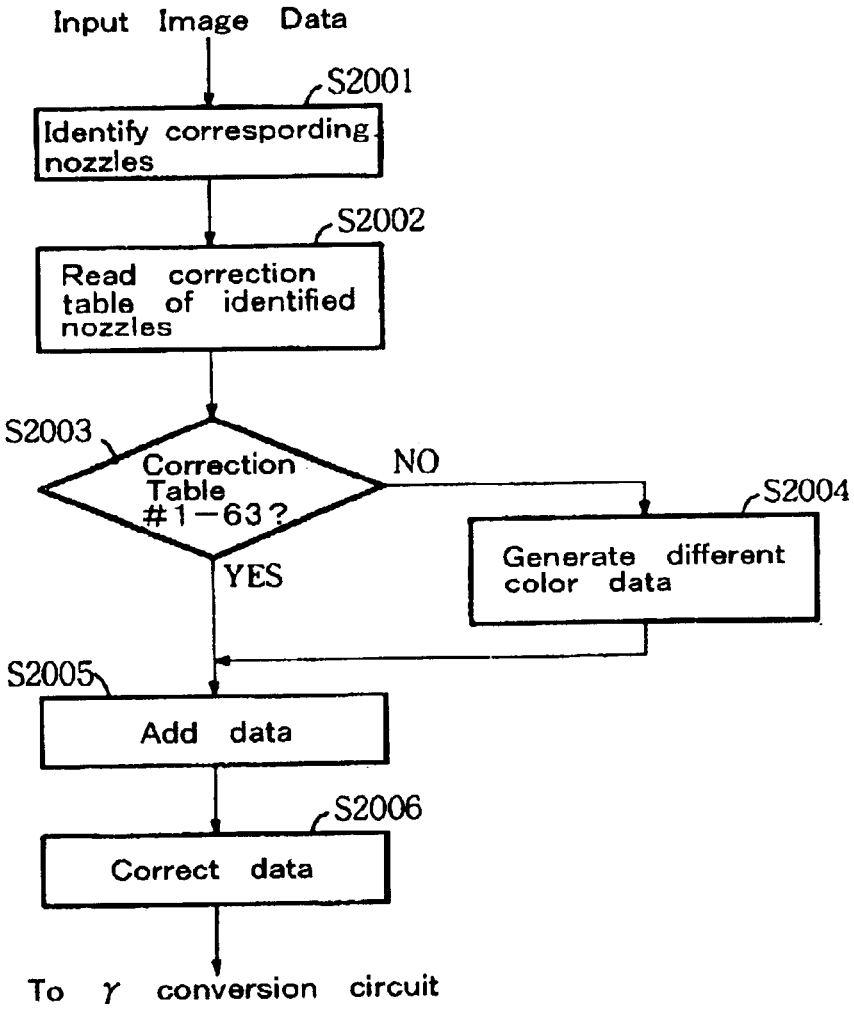
FIG. 8 is a flow chart showing operational procedures by a data conversion circuit.

For that purpose, before determining densities of respective nozzles, averaged density data of one pixel and both next neighbor pixels ($A_{i-1}$, $A_i$, $A_{i+1}$) as shown in FIG. 8 are successively calculated and the averaged value is defined as a nozzle density ave(i). It is desirable to modify the density ratio information into d(i)=ave(i)/AVE. Correction tables mentioned below are formed by using the modified density ratio information.

The density ratio information is processed by a correction table calculating circuit 136 (see FIG. 19) so that correction tables for respective nozzles are determined.

When a correction table number is defined as T(i), the following equations are obtained.

| | |
|---|---|
| T(i) = #63 | 1.31 <d(i) |
| = #(d(i) 1) × 100 + 32 | 0.69 d(i) 1.31 |
| = #1 | 0 < d(i) < 0.69 |
| = #0 | d(i) = 0 |

Figure 20:
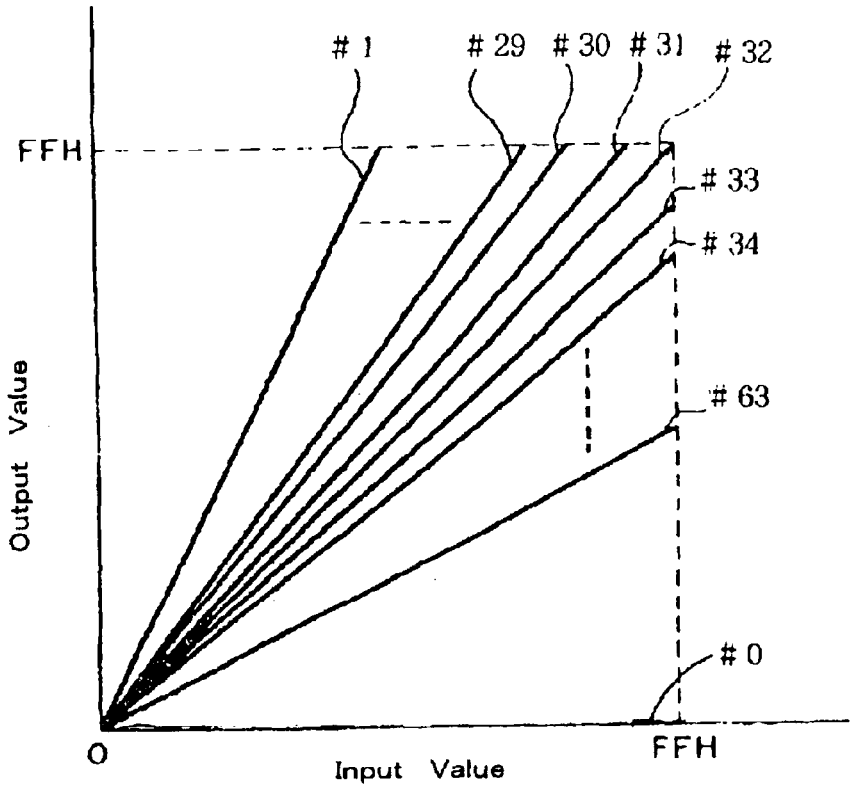
FIG. 20 is a graph showing examples of density compensation tables against nozzles.

Here 64 correction tables #0 to #63 are prepared as shown in FIG. 20, where each table is plotted with its gradient gradually increasing/decreasing from center table #32.

Table #32 has a gradient 1 so that inputted values and outputted values are always equal. FIG. 20 includes tables for determining average densities of 128 eject ports. The density of table #32 is set 50%(80 H), equal to the density of the recording sample. Densities of other table numbers are varied by 1% from the center table #32.

Accordingly, T(i) obtained by the above-described equations indicate converted signal values corresponding to density ratios when signals are always inputted with 80 H density. #0 corresponds to the non-eject nozzles where all output data are set 0 (zero).

When all 128 T(i) are calculated, calculations on correction table numbers for one line are finished.

However, since calculations to determine density ratios are not executed in the present embodiment, determined density values to all nozzles are #0 or #32.

Operations for reading non-eject nozzles and nonuniformity and based on read data calculations for determining corrected correction table numbers are finished for one line, namely, for one color. The same operations and calculations are repeated for the remaining three colors. When correction table numbers for 4 colors are completed, data stored in a correction table number storing unit 137 (see FIG. 19) are renewed. If old correction table numbers in this storing unit are read from stored information 854 in the recording head functioning as a memory means, the stored information 854 are rewritten.

When a detecting operation to detect non-eject nozzle/nonuniformity is not executed, correction table numbers stored in stored information 854 are utilized in succeeding operations.

A data conversion circuit 138 (in FIG. 19) converts outputted image signals to signals for respective heads by utilizing correction tables for respective nozzles. The flow chart of this conversion is illustrated in FIG. 8.

Image signals on C, M, Y and Bk inputted to the data conversion unit 94 are associated with identified corresponding nozzles (step S2001). If recording operations continue, respective color data constituting the same pixel are selected and processed together.

Here correction tables for respective nozzles are read (step S2002), and converted afterward. On the whole, the conversion procedure consists of two cases, a case where the correction table corresponds to any one from #1 to #63 and a case where the correction table corresponds to #0, i.e., a non-eject case (step S2003).

When the correction table corresponds to any one of #1 to #63, inputted data are transmitted to respective color data adding units without processing (step S2005).

On the other hand when the correction table corresponds to #0, i.e., corresponds to a non-eject nozzle, compensation data for compensating the correction table is generated (step S2004). When inputted signals correspond to C, the correction table #C_Bk is selected, and when inputted signals correspond to M, the correction table #M_Bk is selected so as to generate Bk data. When inputted signals correspond to Y, Bk data is not generated. And when inputted signals correspond to Bk, the correction table #Bk_cmy is selected for generating respective C, M and Y data.

In this embodiment, compensation data are generated such that lightness of the original color indicates nearly the same value as that of compensating color, as mentioned above. FIG. 4 is the graph showing the relation between inputted values of respective colors and corresponding outputted lightness. Compensation tables are made based on this figure. For example, when input data of cyan (C) is 192 (inputted on an 8 bit basis), its lightness indicates about 56.

While in black (Bk), when its lightness indicates about 56, inputted data on an 8 bit basis is about 56 (Bk=56); consequently, C=192 is converted to Bk=56. A compensation table (#M_Bk) for magenta (M) compensated by black (Bk) obtained in the same way as mentioned above, as well as the compensation table for C(#C_Bk) are plotted in FIG. 5.

Compensations against yellow (C) are not executed particularly, since yellow (C) always shows high lightness. Compensation against black Bk is made by respective colors C, M and Y in the same ratio. The compensation table for Bk (#Bk_cmy) is also plotted in FIG. 5.

Compensation data are formed by utilizing these compensation tables. Actually, however, relations between dot diameters to be recorded and pixel pitches should also be considered. In the present embodiment, for example, a dot diameter to be recorded is about 95 μm and a pixel pitch is 63.5 μm. This means that an area factor of 100% can obtained, even when impacted dot recorded with 100% recording duty is deviated a little bit.

Accordingly, it can be concluded that, for example, when only one nozzle is in the non-eject status, influences from dots of neighbor pixels on the non-eject pixel are fairly significant.

In other words, a compensated dot recorded on a non-eject portion influences neighbor pixels more than a little.

This is also expressed as follows: when non-eject nozzles are not continued, a lower compensation data than the obtained data from the relation in lightness can be applicable.

Figure 6:
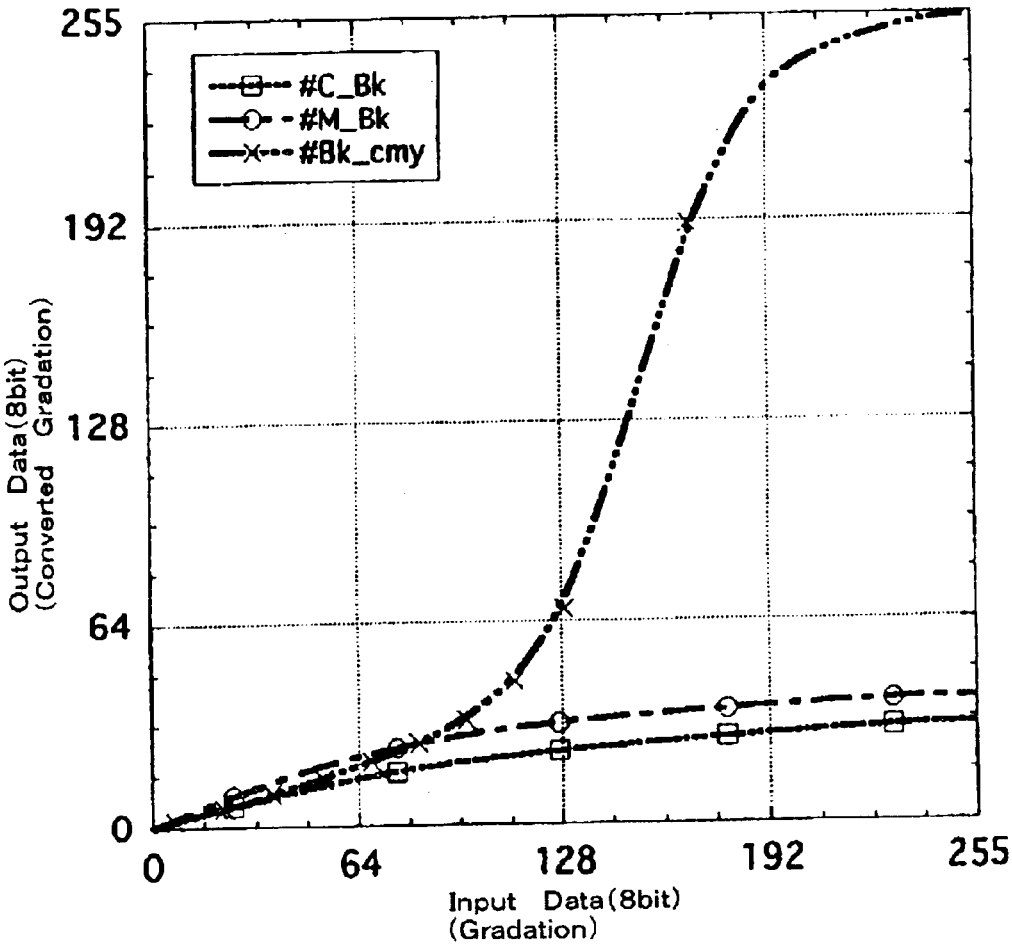
FIG. 6 is a graph showing conversion examples when recording defects are compensated by different colors.

Consequently, compensation tables shown in FIG. 6 are employed in the present embodiment.

Generated compensation data of respective colors in the above-mentioned ways are transmitted to a data adding unit (step S2005).

The data adding unit has a function for holding respective color data and a calculating function. If compensation data is inputted to this unit in the first place, data is kept as it is. If other data are already kept, inputted data are added. If added results exceed 255 (FFH), they are kept as 255. In the present embodiment, simple adding procedures are employed, but other calculating methods and tables may be utilized, if necessary.

After adding procedures to all colors, C, M, Y and Bk, are finished, added results are transmitted to a data correction unit and data kept in the data adding unit is reset so as to wait for processing of the next pixel. Data transmitted to the data correction unit are converted according to correction tables (#0 to #63) (step S2006). Thus, a series of data conversion procedures are finished.

Data converted in the above-mentioned way are transmitted via a γ conversion circuit 95, a conversion circuit to binary data 96 (see FIG. 17) and so forth and outputted as images.

When images outputted in this way are intently observed from a close distance, non-eject portions can be recognized, but image quality is excellent on the whole.

Second Embodiment

Processing Examples by Head Shading

Among a series of operations of the head shading, i.e., nonuniformity compensations, compensations against non-eject nozzles are executed. Hereinafter compensation procedures are explained more specifically.

The present embodiment is executed in the same system as mentioned above. Different features from the previous examples are: (1) corrections to nonuniformity are executed and (2) correction data by other colors are not generated in the present example.

Hereinafter data conversions, namely, processing operations by the non-eject nozzle/density nonuniformity measuring unit 93 and the data conversion unit 94 (in FIG. 17), mainly on the two features (1) and (2), are explained.

Processing operations by the non-eject nozzle/density nonuniformity measuring unit 93 are basically the same as the previous example as shown in FIG. 18. As shown in the block diagram in FIG. 19, at first the non-eject/nonuniformity pattern for reading is recorded. The recorded pattern is read by employing the CCD sensor. The read data are processed such as adding calculations, averaging calculations and the like so that density n(i) to be recorded corresponding to respective nozzles as shown in FIG. 26 is obtained.

Fundamental factors to generate nonuniformity are explained for more easily understanding the present example.

Figure 15A:
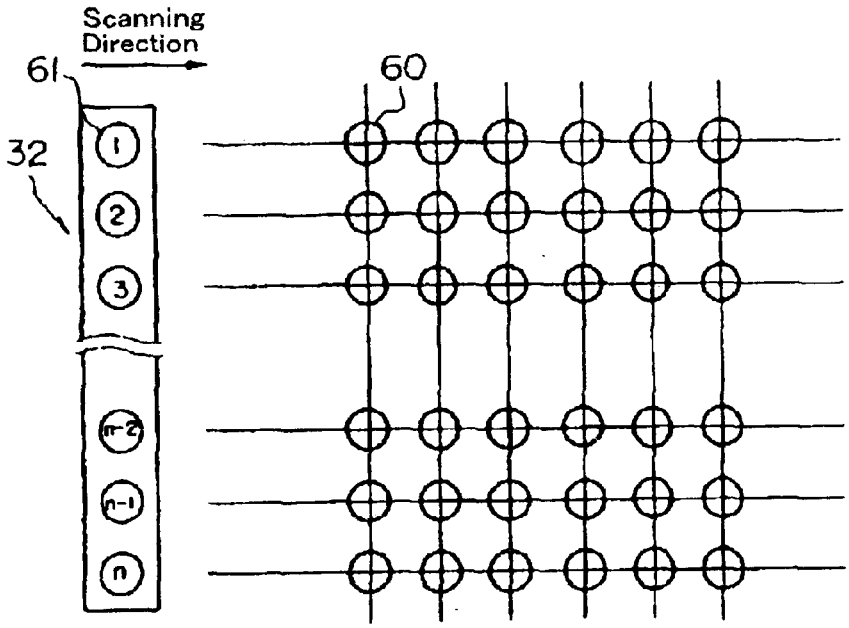
FIG. 15A is a schematic drawing showing a recorded status by an ideal recording head and FIG. 15B is a schematic drawing showing a recorded status with drop diameter dispersions and with twisted ejection.

FIG. 15A is the schematic view showing the enlarged recording status recorded by an ideal recording head 32. In the figure, a reference numeral "61" represents ink eject ports arranged in the recording head 32. When recorded by the recording head 32, ink spots 60 with uniform drop diameter (liquid droplet diameter) are recorded in an arrayed state on the recording paper.

The schematic drawing in the figure is an example recorded with so called full ejection (all eject ports are activated). However, even when recorded with a half tone of 50% ejection, nonuniformity is not generated in this case.

Figure 15B:
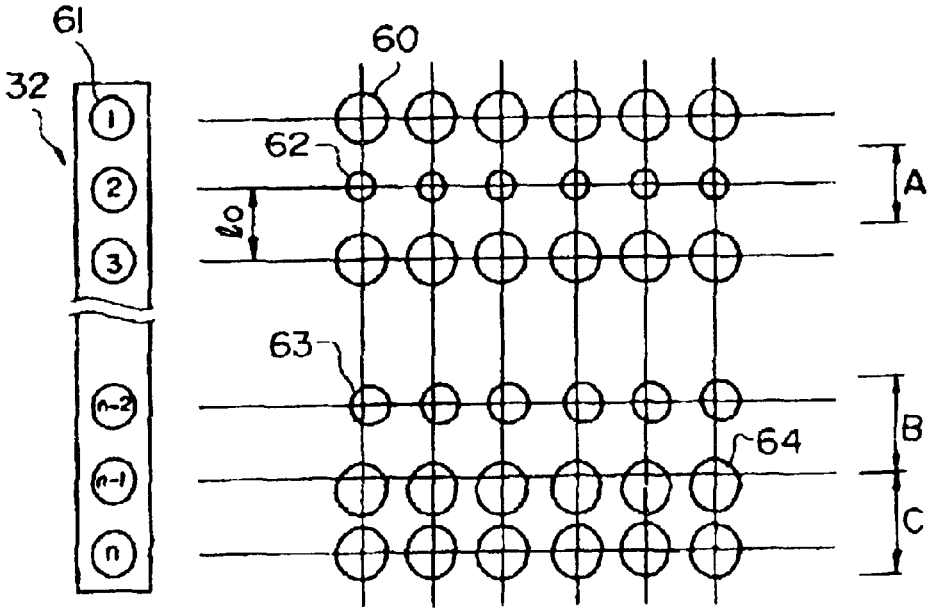

On the other hand, in a case shown in FIG. 15B, diameters of drops 62 and 63 ejected from second and (n−2)th eject ports are smaller than the other, and drops from (n−2)th and (n−1)th eject ports are recorded on positions deviated from ideal positions. More specifically, drops from the (n−2)th eject port are recorded at right-upward positions from ideal centers and drops from the (n−1)th eject port are recorded at left-downward positions from ideal centers.

Area A indicated in FIG. 15B appears as a thin streak on a recorded image. Area B also results in a thin streak, because a distance between centers of drops from the (n−1)th and (n−2)th eject ports is larger than an average distance $I_0$ between two neighbor drops. On the other hand, area C appears as a thicker streak than other areas because a distance between centers of drops from the (n−1)th and nth eject ports is smaller than the average distance $I_0$ between two neighbor drops.

As mentioned above, density nonuniformity appears mainly due to dispersed drop diameters and deviated drops from centers (usually called the twisted state).

As a means to cope with the density nonuniformity, it is effective to employ the following method such that the image density of a certain area is detected and the quantity of ink to be ejected to that area is controlled based on the detected image density.

Figure 16A:
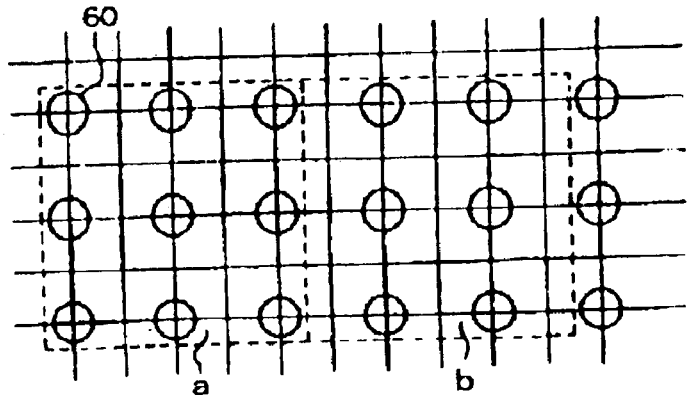
FIG. 16A is a schematic drawing showing a 50% half toned status by an ideal recording head and FIG. 16B is a schematic drawing showing a 50% half toned status with dispersed drop diameters and twists.
Figure 16B:
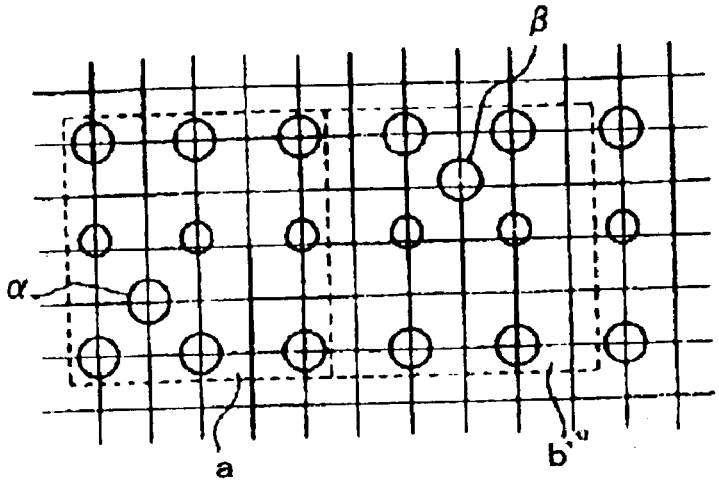

The density nonuniformity, caused by dispersed drop diameters or twisted states as shown in FIG. 16B, compared with a recorded image by the ideal recording head recorded with a 50% half tone as shown in FIG. 16A, can be made inconspicuous in the following way. For example, when summed dot areas existing in area a surrounded by a broken square in FIG. 16B are adjusted so as to be near to a summed dot area a surrounded by a broken square in FIG. 16A, even an image recorded by a recording head having characteristics as shown in FIG. 16B is judged by human eyes to have the same density as that of the image in FIG. 16A.

In the same way an area b shown in FIG. 16B can be adjusted so as to remove the density nonuniformity.

FIG. 16B illustrates adjusted density compensation results in a model form for simple explanation. Reference characters "α" and "β" represent dots for compensation.

This system can be applied to non-eject nozzles, when drop diameters from non-eject nozzles are set to nearly zero.

In this respect, modified density ratio data D(i) for respective nozzles in the previous example defined as follows are important.

$$D(i)=ave(i)/AVE$$

Here ave(i) is a density obtained by averaged densities of three successive nozzles (n(i−1), n(i), n(i+1)), namely.

$$ave(i)=(n(i-1)+n(i)+n(i+1))/3$$

And AVE is defined as follows.

$$AVE=\Sigma(n(i)/128),\ \text{here } i=1 \text{ to } 128$$

When a $i_0$th nozzle is a non-eject nozzle, it is set that $n(i_0)=d(i_0)=0$. Consequently, the effective density of both neighbor $(i_0+1)$th and $(i_0-1)$th nozzles, i.e., $ave(i_0+1)$ and $ave(i_0-1)$, respectively indicate much smaller values than $n(i_0-1)$ and $n(i_0+1)$. As a result, since density ratio information $d(i_0+1)$ and $d(i_0-1)$ become virtually smaller, higher density output values are set by a compensation table mentioned below so as to compensate non-eject nozzles. Therefore effective density ave(i) for respective nozzles are not limited to simply averaged values, but properly weighted averaged values, for example, $ave(i)=(2n(i-1)+n(i)+2n(i+1))/5$ or the like, can be employed.

The density ratio information d(i) obtained in the above-mentioned way is processed by a correction table calculating circuit 136 (see FIG. 19) of the data conversion unit 94 so that correction tables for respective nozzles are determined. Since this processing procedure is the same as the previous embodiment, further explanations are omitted.

Figure 21:
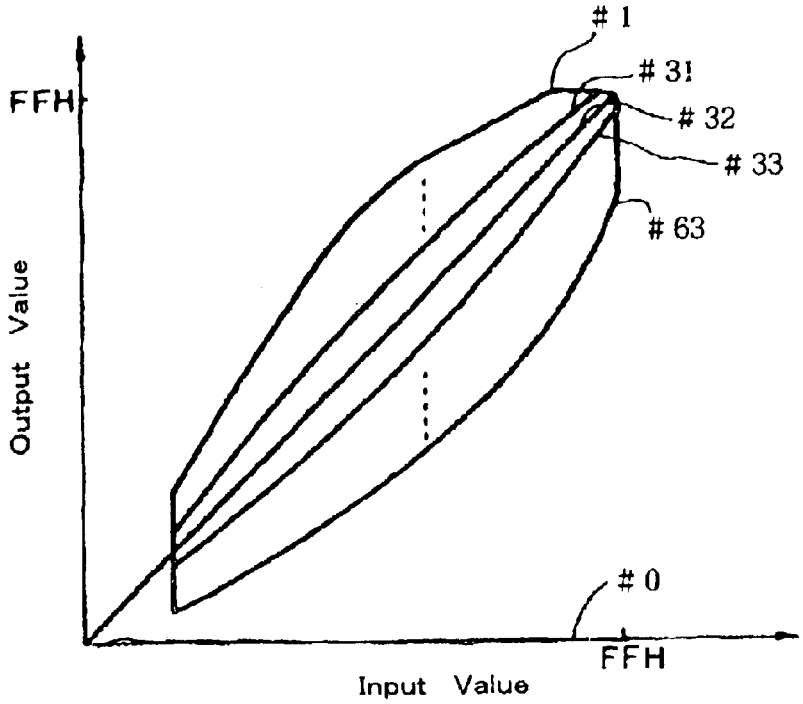
FIG. 21 is a graph showing examples of non-linear density compensation tables against nozzles.

64 density correction tables are depicted in FIG. 20, but correction tables are increased or decreased in accordance with required conditions. Non-linear correction tables as shown in FIG. 21, for example, can be also employed in accordance with properties of media to be recorded and inks.

After correction tables for all nozzles are determined, contents in a correction table number storing unit 137 and stored information on recording head 854 are renewed (see FIG. 19). Data conversion on an image to be outputted is executed by a data conversion circuit 138 by utilizing the determined correction tables. In this case data are converted in the same way as the previous example, but simpler, since compensations by other colors are not executed.

A flow chart for the present case is similar to the flow chart shown FIG. 8, but the following steps are omitted: correction table identifying step (S2003), generating different color data (step S2004) and data adding step (S2005). Compensated data are transmitted to a γ-conversion circuit 95, if required, then converted to binary data by a conversion circuit 96 to binary data and outputted as images.

Images obtained in the above-mentioned way are excellent in such a manner that, effects by non-eject statuses are hardly observed, particularly in highlighted portions.

However, white streaks caused by non-eject statuses are not always compensated in portions recorded with high duty.

Third Embodiment

In the present embodiment, examples where the coated papers with a blotting rate of around 2.0 are employed are explained.

Head Shading and Compensation with Different Colors

Since the present embodiment is an embodiment where compensation with different colors of the first embodiment and compensation with the head shading of the second embodiment are combined, the compensation can be executed by the same system employed in the head shading of the second embodiment.

Hereinafter data conversion processes by the present embodiment are explained.

The non-eject nozzle/density nonuniformity measuring unit 93, shown in FIGS. 17 and 19, executes the same operations as the first embodiment; more specifically, the operation to record a non-eject/nonuniformity pattern for reading, the operation to detect non-eject nozzles, the operation to calculate recording densities for respective nozzles and the operation to calculate the density ratio information of respective nozzles are executed.

The calculated density ratio information is processed by the correction table calculating circuit 136 in the data conversion unit 94 similarly to the first embodiment and correction tables for respective nozzles are determined. The determined correction tables renew contents in the correction table number storing unit 137 and stored information on recording head 854, and the renewed contents are utilized by the data conversion circuit 138. Processing operations in the data conversion circuit 138 are basically the same as operations in the above-mentioned embodiment (see FIG. 8).

A different point from the previous embodiment is that when a nozzle indicates the non-eject status, namely the correction table number is #0, contents of the compensation table by different colors for generating compensation data by different colors are different from the previous embodiment. In the present embodiment, it is desirable not to compensate highlighted portions recorded with relatively low recording duty by different colors, since density corrections for respective nozzles are executed by the shading and densities of next neighbor nozzles to the non-eject nozzle are corrected so as to compensate the non-eject nozzle. Even when portions recorded with high recording duty are compensated, extents of compensations by different colors can be reduced, as compared with the above-mentioned embodiment, due to the above-mentioned effects by density corrections in next neighbor nozzles.

More specifically, when correction curves for C and M as shown in FIG. 5 are expressed as f(x), new correction curves for Bk are expressed as $\beta^*(x-\delta)$. An example of the new correction curve is plotted in FIG. 7. The factor "β" in the new correction curves has a range of $0<\beta<1$ and the factor "δ" has a range of $0\leqq\delta\leqq255$. In the correction curve plotted in FIG. 7, β is about 0.3 and δ is about 128.

Figure 7:
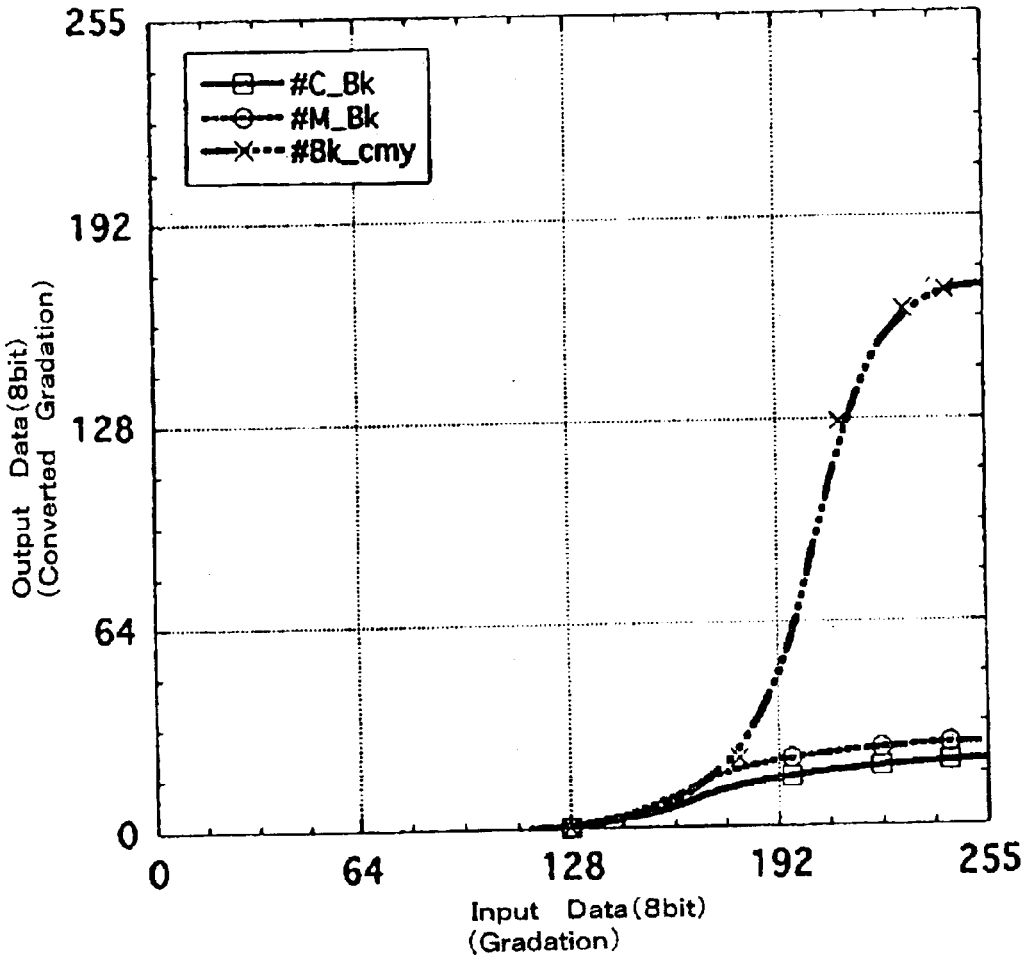
FIG. 7 is a graph showing conversion examples when recording defects are compensated by different colors.

In the present embodiment, data conversions are executed by employing correction tables by different colors shown in FIG. 7.

Dot numbers for compensations by different colors can be reduced, since dots ejected from next neighbor nozzles to the non-eject nozzle are recorded more by the above-mentioned head shading operations. For example, FIG. 3F is the conceptual diagram showing the compensation table so as to correct densities of neighbor nozzles to the non-eject nozzle to raise 1.5 times (corresponds to a correction curve 4*b*) the inputted values as shown in FIG. 20 compared with the case without compensations (corresponds to a correction curve 4*a*). These compensations recorded with 1.5 times density correspond to FIGS. 3A, 3B and 3D. Dots up to 4 can be recorded in respective grids shown in FIGS. 3A, 3B, 3C and 3D. Therefore, FIG. 3A illustrate a uniform pattern to be recorded with low duty, i.e., one dot/grid.

Nozzles in a recording head to be used for recording dots in FIG. 3C are arrayed in a vertical direction of this figure, where a non-eject nozzle corresponds to a third row from the top. In these figures, circles in solid line indicate dot positions recorded by normal nozzles, circles in fine broken line indicate dot positions to be recorded by non-eject nozzles and circles in coarse broken line indicate dot positions to be compensated. As can be understood from these figures, it is desirable that compensations by the next neighbor nozzles to the non-eject nozzle should be recorded with densities of 1.5 times.

However, in images recorded with high recording duty, white streaks tend to be seen conspicuously. Since sometimes dots are recorded in small sizes depending on recording media, white streaks are seen conspicuously in images recorded with more than ½ recording duty. In images to be recorded with high recording duty, defect portions can be made inconspicuous, when positions corresponding to non-eject nozzles are compensated by dots from other colors. Therefore, in images to be recorded with more than ⅔(67%) recording duty, dots from neighbor nozzles to non-eject nozzles are recorded with 100% recording duty and at the same time positions corresponding to the non-eject nozzles are compensated by other colors. When defects are made inconspicuous only by neighbor nozzles to the non-eject nozzles, theoretically it is necessary to record with more than 100% recording duty. However, since positions corresponding to non-eject nozzles are compensated by other colors, recording duty to record dot numbers from the neighbor nozzles can be reduced to 100%.

When images are recorded by converting data as mentioned above, images with high quality, including almost all portions including highlighted portion and shadow portions, are obtained.

Operating conditions regarding whether compensations by other colors are to be executed on a selected medium to be recorded or not can be determined and stored in the recording apparatus or in a printer driver beforehand. However it is preferable to employ successive procedures comprising steps of recording ink droplets on a top end of a medium to be recorded, measuring diameters of formed dots from droplets by the recording apparatus and determining a blotting rate of the medium to be recorded.

The present invention exhibits its features more effectively when applied to recording heads or recording apparatuses employing ink-jet recording methods, particularly, methods utilizing thermal energy generating means (electro-thermal energy conversion body, laser light source and the like) in order to utilize the generated energy for causing a phase change in ink.

It is preferable to employ such typical methods, constitutions or principals of recording apparatuses, for example, disclosed in U.S. Pat. Nos. 4,723,129 and 4,740,796. The disclosed methods can be applied either to a so-called on-demand type recording apparatus or to a continuous type recording apparatus. However, the on-demand type recording apparatus is effective because at least one driving signal corresponding to information to be recorded is applied to an electro-thermal energy conversion body arranged on a sheet or a liquid path where ink is kept so as to raise the temperature above a nucleate boiling point in a short period by generating energy in the electro-thermal energy conversion body, and consequently, bubbles can be formed in accordance with the applied driving signal. Ink is ejected via an opening for ejecting by growing/shrinking generated bubbles so that at least one droplet is formed. It is more preferable to adjust the applied signal into a pulse form, since bubbles are instantly and properly grown/shrunk in accordance with the applied signal, namely, liquid (ink) ejection with excellent response in particular is attained. Driving signal forms disclosed in U.S. Pat. Nos. 4,463,359 and 4,345,262 are suitable to employ as the driving signals with pulse forms. In addition, when conditions described in U.S. Pat. No. 4,313,124, an invention relating to temperature raising rate on the above-mentioned thermal active surface, are employed, more excellent recording results can be attained.

Arrangements of recording heads described in U.S. Pat. Nos. 4,558,333 and 4,459,600, disclosing eject ports arranged on bending areas to which thermal energy is applied as well as combinations of eject ports, liquid paths and electro-thermal conversion bodies, are included in the present invention. In addition, effects by the present invention are also exhibited in an invention described in Japanese Laid-open Patent Application No. 59-123670 relating to common slits as eject ports corresponding to a plurality of electro-thermal energy conversion bodies, and in an invention described in Japanese Laid-open Patent Application No. 59-138461 disclosing an arrangement where openings to absorb pressure waves from thermal energy are arranged opposed to eject ports. In other words, recording operations are effectively executed without fail by the present invention, no matter what types of recording heads are employed.

The present invention also can be applied to a full line type recording head capable of recording on a recording medium with a maximum width. The full line type recording head can be constituted either by combining a plurality of recording heads or an integrally formed recording head.

Further, the present invention can be applicable to any type of recording head such as the above-mentioned serial type, an exchangeable chip type recording head capable of being supplied ink from a recording apparatus, onto which the recording head is mounted or electrically connected, and a cartridge type recording head where an ink tank is integrally formed with the recording head.

It is preferable to add a recording head recovery means and auxiliary supporting means as the components to the recording apparatus of the present invention, since the present invention can exhibit its features more effectively. More specifically, these include a capping means for capping the recording head, a cleaning means, a pressurizing or suction means, a spare heating means comprising an electro-thermal conversion body, another heating element, or a combination of these heating bodies, or pre-ejecting means for ejecting ink before recording.

Either one recording head for a mono color ink or a plurality of recording head for mono color inks with different densities or a plurality of inks are applicable to the present invention. Namely, the present invention is applicable not only to a recording apparatus employing a recording mode with a main color such as black, but to a recording apparatus employing an integrally arranged recording head or a combination of a plurality of recording heads. In addition, the present invention is quite effective in a recording apparatus employing at least one of the following recording modes: a mono-color mode using one color, a multi-color mode using a plurality of different colors and a full color mode attained by mixing primary colors.

The present invention resolves nonuniformity in a recorded image such as white streaks generated by non-eject dots or the present invention makes the nonuniformity caused by non-eject statuses be less recognized by human eyes, which suppresses operating costs of the ink-jet recording apparatus from increasing and further attains effects enabling higher recording rates.

What is claimed is:

1. A recording apparatus for recording a color image on a recording medium by utilizing a recording head on which a plurality of recording elements are arrayed, comprising:

recording head driving means to drive said plurality of recording elements of said recording head in accordance with image data;

a plurality of compensation means to compensate a position to be recorded by a recording element which does not execute a recording operation, among said recording elements, by utilizing respectively different methods; and selection means to employ selectively at least one compensation means from said plurality of compensation means in accordance with a kind of medium to be recorded.

2. The recording apparatus according to claim 1, wherein said plurality of compensation means comprises a compensation means which executes a compensation recording operation, on a corresponding position where the recording element does not execute the recording operation, by a different color from the color corresponding to the recording element which does not execute the recording operation.

3. The recording apparatus according to claim 2, wherein said compensation means executes recording operations corresponding respectively to a plurality of colors, and at the same time executes compensation recording operations by employing a color having similar lightness to a color corresponding to the recording element which does not execute the recording operation.

4. The recording apparatus according to claim 1, wherein said plurality of compensation means comprises a compensation means which compensates a position to be recorded by the recording element which does not execute the recording operation by correcting image data corresponding to recording elements in the vicinity of the recording element which does not execute the recording operation based on image data corresponding to the recording element which does not execute the recording operation.

5. The recording apparatus according to claim 4, wherein said compensation means corrects density data indicated by image data corresponding to recording elements in the vicinity of the recording element which does not execute the recording operation, based on density data indicated by image data corresponding to said recording element which does not execute the recording operation.

6. The recording apparatus according to claim 1, wherein said plurality of compensation means comprises a first compensation means which executes compensation recording, on a position to be recorded by the recording element which does not execute the recording operation, by a different color from the color corresponding to the recording element which does not execute the recording operation; and a second compensation means which executes compensation recording on a position to be recorded by the recording element which does not execute the recording operation by correcting image data corresponding to recording elements in the vicinity of the recording element which does not execute the recording operation based on image data corresponding to the recording element which does not execute the recording operation.

7. The recording apparatus according to claim 6, wherein when the kind of medium is a first medium to be recorded, only said second compensation means is selected, and when the kind of medium is a second medium to be recorded, at least said first compensation means is selected.

8. The recording apparatus according to claim 7, wherein said selection means selects only said second compensation means when the kind of medium is the first medium to be recorded, and said selection means selects both said first compensation means and said second compensation means when said kind of medium is the second medium to be recorded.

9. The recording apparatus according to claim 7 or 6, wherein the first medium to be recorded is ordinary paper, and the second medium to be recorded is a glossy paper.

10. The recording apparatus according to claim 7 or 6, wherein the first medium to be recorded is a medium with a blotting rate of 2.5 or more, and the second medium to be recorded is a medium with a blotting rate of less than 2.5.

11. The recording apparatus according to claim 7 or 8, wherein said recording head further comprises control means to control an ejecting quantity of the recording head in order to execute the compensation recording operation only by said second compensation means, when the first medium to be recorded is selected.

12. The recording apparatus according to any one of claims 6 to 8, wherein said first compensation means executes recording operations corresponding respectively to a plurality of colors, and at the same time executes compensation recording operations by employing a color having similar lightness to a color corresponding to the recording element which does not execute the recording operation.

13. The recording apparatus according to claim 12, wherein said first compensation means has a correction means for correcting image data corresponding to the recording element which does not execute the recording operation in accordance with a color corresponding to a recording element employed for a compensation recording operation, and executes the compensation recording based on the corrected image data by said first compensation means.

14. The recording apparatus according to claim 13, wherein said compensation means has a correction means for correcting image data corresponding to the recording element which does not execute the recording operation in accordance with a color corresponding to a recording element employed for a compensation recording operation, and executes the compensation recording based on the corrected image data by said compensation means.

15. The recording apparatus according to any one of claims 6 to 8 wherein said second compensation means corrects density data indicated by image data corresponding to recording elements in the vicinity of the recording element which does not execute the recording operation, based on density data indicated by image data corresponding to said recording element which does not execute the recording operation.

16. The recording apparatus according to any one of claims 1 to 8, wherein said recording element which does not execute the recording operation includes a recording element incapable of executing the recording operation.

17. The recording apparatus according to any one of claims 1 to 8, wherein said recording head is an ink-jet head having a plurality of nozzles from which ink is ejected for recording when said recording elements are driven.

18. The recording apparatus according to claim 17, wherein each recording element comprises an electro-thermal body which supplies thermal energy to ink so that ink is ejected from a corresponding nozzle by bubbles generated in the ink by the thermal energy.

19. The recording apparatus according to any one of claims 1 to 8, wherein said recording head further comprises measuring means to measure a blotting rate of the medium to be recorded.

20. A recording method for recording a color image on a recording medium by utilizing a recording head on which a plurality of recording elements are arrayed, comprising the steps of:

identifying a recording element which does not execute a recording operation;

recognizing a kind of medium to be recorded;

selecting at least one compensation method among a plurality of respectively different compensation methods for compensating a position to be recorded by the recording element which does not execute the recording operation; and recording for compensation on the position to be recorded by the recording element which does not execute the recording operation, wherein in said selecting step the at least one compensation method is selected among the plurality of respectively different compensation methods in accordance with the kind of medium to be recorded recognized in said recognizing step.

21. A program for carrying out the method according to claim 20.

22. A program to run a computer for controlling a recording apparatus for recording a color image on a recording medium by utilizing a recording head on which a plurality of recording elements are arrayed, comprising the steps of:

identifying a recording element which does not execute a recording operation;

recognizing kinds of media to be recorded; and selecting at least one compensation method among a plurality of respectively different compensation methods for compensating a position to be recorded by a recording element which does not execute the recording operation in accordance with a kind of medium recognized in said recognizing step.

* * * * *